US012006119B2

(12) United States Patent
Perea-OcHoa et al.

(10) Patent No.: US 12,006,119 B2
(45) Date of Patent: Jun. 11, 2024

(54) CONSUMPTION PACKET WITH DRINKING ARRANGEMENT

(71) Applicants: Jesus Perea-OcHoa, Montebello, CA (US); Gina Morales, Rancho Cucamonga, CA (US)

(72) Inventors: Jesus Perea-OcHoa, Montebello, CA (US); Gina Morales, Rancho Cucamonga, CA (US)

( * ) Notice: Subject to any disclaimer, the term of this patent is extended or adjusted under 35 U.S.C. 154(b) by 459 days.

(21) Appl. No.: 16/826,077

(22) Filed: Mar. 20, 2020

(65) Prior Publication Data

US 2020/0299047 A1 Sep. 24, 2020

Related U.S. Application Data

(60) Provisional application No. 62/821,420, filed on Mar. 20, 2019.

(51) Int. Cl.

| | |
|---|---|
| ***B65D 75/58*** | (2006.01) |
| ***B65D 75/00*** | (2006.01) |
| ***B65D 75/54*** | (2006.01) |

(52) U.S. Cl.

CPC ..... *B65D 75/5866* (2013.01); *B65D 75/008* (2013.01); *B65D 75/545* (2013.01)

(58) Field of Classification Search

CPC ..... B65D 75/5866; B65D 75/008; B65D 75/545; B65D 77/283

See application file for complete search history.

(56) References Cited

U.S. PATENT DOCUMENTS

| | | | | |
|---|---|---|---|---|
| 6,334,711 | B1 * | 1/2002 | Risgalla | B65D 75/58 426/123 |
| 6,481,889 | B2 * | 11/2002 | Delsahut | B65D 81/03 383/44 |
| 9,856,064 | B2 * | 1/2018 | Schnabel | B32B 7/14 |
| 2014/0050424 | A1 * | 2/2014 | Hilsenrath | B65D 77/28 383/41 |

* cited by examiner

*Primary Examiner* — Vishal Pancholi
*Assistant Examiner* — Robert K Nichols, II
(74) *Attorney, Agent, or Firm* — David & Raymond Patent Firm; Raymond Y Chan

(57) ABSTRACT

A consumption packet includes a bag and a dispensing arrangement. The bag includes a first bag wall and a second bag wall defining a cavity between the first and second bag walls. The bag further has an enclosable area defined at the first bag wall and a pouch opening formed within the enclosable area. The dispensing arrangement includes a sealing flap extended from the second bag wall and folded on the first bag wall to enclose the enclosable area thereof so as to seal the pouch opening by the sealing flap, wherein the sealing flap is unfolded from the enclosable area to unseal the pouch opening.

9 Claims, 23 Drawing Sheets

CONSUMPTION PACKET WITH DRINKING ARRANGEMENT

CROSS REFERENCE OF RELATED APPLICATION

This application is a non-provisional application that claims the benefit of priority under 35 U.S.C.§ 119(e) to a provisional application, application No. 62/821,420, filed Mar. 20, 2019, which is incorporated herewith by reference in its entity.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates not only a beverage product any product with possible human consumption for example but not limited oils, pills, creams, lotion, fruits, cannabis, ointments, powder, chewable, films, tablets, capsules, and medications and more particularly to a beverage packet with a drinking arrangement, wherein a drinking opening is sealed and enclosed by a sealing flap and is unsealed when the sealing flap is unfolded for ensuring a proper hygiene of the product being packet. And furthermore to provide and a variety of sizes and shapes where the packets are flexible to meet storage demands and are ergonomic and convenient.

Description of Related Arts

Conventional beverage packets are generally categorized into two types, i.e. a cap type beverage packet and a non-cap type beverage packet. The cap type beverage packet comprises an air impermeable beverage bag having a beverage cavity and an opening, a mouth piece extended out of the beverage cavity through the opening, and a cap detachably coupled at the mouth piece. Accordingly, a user is able to detach the cap from the mouth piece and drink the beverage in the cavity via the mouth piece. However, the cap type beverage packet has several drawbacks. The mouth piece, the cap and the beverage bag are made of different materials. Therefore, the manufacturing cost of such beverage packet is relatively high and the manufacturing process thereof is relatively limited to put different components together. Even though a portion of the mouth piece is enclosed by the cap for hygiene purpose, the user's lips may accidentally touch the uncovered portion of the mouth piece and/or the beverage bag. Most cap containers are bulky and do not have considerable reduction in cubic space as the product in the packet is being used. Additional todays bulky rigid container lack the ability to change shapes base on user available space like in a gym bags or purses. The current bottling industry is wasting excessive material and the industry lacks the production ability for convenient sizes packets, like the production of a business/credit card size packets, ketchup size packet or smaller size packets that will allow users to save the wrappers after consumption for reference and product information without requiring pen and paper to remember. Thereby reducing less litter and increase utilizing of existing products like phone credit card holders and purses. The numerous shapes and sizes will allowed for additional direct advertisement to the consumer and for third party advertisement on the packets for additional advertisement.

The non-cap type beverage packet generally comprises an air impermeable beverage bag having a beverage cavity and a tearing portion, wherein the tearing portion is arranged to be torn off from the beverage bag to form an opening for communicating with the beverage cavity. The major drawback of such beverage packet is that design of the beverage bag cannot keep the opening being cleaned during the usage. Furthermore, once the opening is formed by tearing off the tearing portion, the opening of the beverage bag cannot be re-sealed or enclosed anymore. Dirt or germs may enter into the beverage cavity through the uncovered opening to pollute the beverage in the beverage bag. Additionally because of the limitations mention above the packet products need to be finished by the user and/or immediately discarded as additional waist because these packet have a permanent hole and therefore are not suitable for multi-tasking on the go situations.

SUMMARY OF THE PRESENT INVENTION

The invention is advantageous in that it provides a beverage packet with a drinking arrangement, which is a hygiene product to normally seal around an area where the user's lips touching the beverage packet.

Another advantage of the invention is to provide a beverage packet with a drinking arrangement, wherein not only the opening of the beverage packet but also a drinking tool are normally sealed and enclosed by the sealing flap for hygiene purpose.

Another advantage of the invention is to provide a beverage packet with a drinking arrangement, wherein the drinking tool, such as a drinking biodegradable straw, stander straw or a mouth piece, can be built-in with the beverage packet and sealed by the sealing flap so as to keep the drinking tool clean and to prevent any loss of the drinking tool before it is used.

Another advantage of the invention is to provide a beverage packet with a drinking arrangement, wherein the user is able drink the beverage in the beverage packet by simply unfolding the sealing flap to expose and unseal the drinking opening.

Another advantage is the invention packets require much less material than current containers.

Another advantage of the invention is to provide a beverage packet with a drinking arrangement, wherein the drinking opening is re-sealable by the sealing flap.

Another advantage of the packet is that the cubic space dimensions collapse as the product in the packets is being used.

Another advantage of the invention is to provide a beverage packet without a drinking arrangement, wherein the drinking opening is re-sealable by the sealing flap.

Another advantage of the invention is to provide any product a packet without a drinking arrangement, wherein the hygiene opening pouch is re-sealable by the sealing flap.

Another advantage of the packet is to provide a flexible container where the shape can mold to the external environment requirements.

Another advantage of the invention is to provide a beverage packet with a drinking arrangement, wherein no expensive or complicated actions are required by the user to employ in the present invention in order to achieve the above mentioned objects. Therefore, the present invention successfully provides an economic and efficient solution for providing a simple sealing and hygiene configuration for the beverage packet.

Another advantage of the invention is to reduce current plastic, aluminum and paper material requirements for bottling.

Another advantage of the invention is to reduce land waist spaces, cans, glass bottles, plastic bottles, paper containers.

Another advantage of the invention is to produce a low manufacture cost for packets that require limited quantity cubic space.

Another advantage of the invention it reduces freshwater utilization by not having to repeatedly wash cups, glasses, and or mugs.

Another of the advantage of the invention reduce memorabilia waist of cups, glasses and mugs because the packet can be save as the memorabilia with the logo commemorating the event.

Another advantage of the invention is to provide unlimited sizes and shapes of the packets.

Another advantage of the invention to provide a flexible container able to change to multiple shapes for more accommodating storing requirements.

Another advantage is to provide a beverage product packet business/credit card size packet or smaller, wherein the drinking opening is re-sealable by the sealing flap.

Another advantage is to provide any product packet business/credit card size packet or smaller, wherein the opening pouch opening is re-sealable and cover by the sealing flap.

Another advantage is to provide any packets a business/credit card size or smaller attachment for promotional samples.

Additional advantages and features of the invention will become apparent from the description which follows, and may be realized by means of the instrumentalities and combinations particular point out in the appended claims.

According to the present invention, the foregoing and other objects and advantages are attained by a beverage packet which comprises a beverage bag and a drinking arrangement.

The beverage bag includes a first bag wall and a second bag wall defining a beverage cavity between the first and second bag walls. The beverage bag further has an enclosable area defined at the first bag wall and a drinking opening formed within the enclosable area.

The drinking arrangement includes a sealing flap extended from the second bag wall and folded on the first bag wall to enclose the enclosable area thereof so as to seal the drinking opening by the sealing flap, wherein the sealing flap is unfolded from the enclosable area to unseal the drinking opening.

Alternatively, the product bag, as an replacement of the beverage bag, includes a first bag wall and a second bag wall defining as a product pouch cavity between the first and second bag walls. The product bag further has an enclosed area define at the first bag wall and pouch like opining formed within the enclosable area.

It is important to mention the seals can be chemical, natural substances, mechanical, physical, and or electrostatic attraction of plastics, or any additional Food And Drug Administration (FDA) modality that are approved for coming in contact with the mouth and with oral products for human consumption.

Another advantage of the invention is to continue utilizing existing materials and technology for the production of the packets in accordance with the (FDA).

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
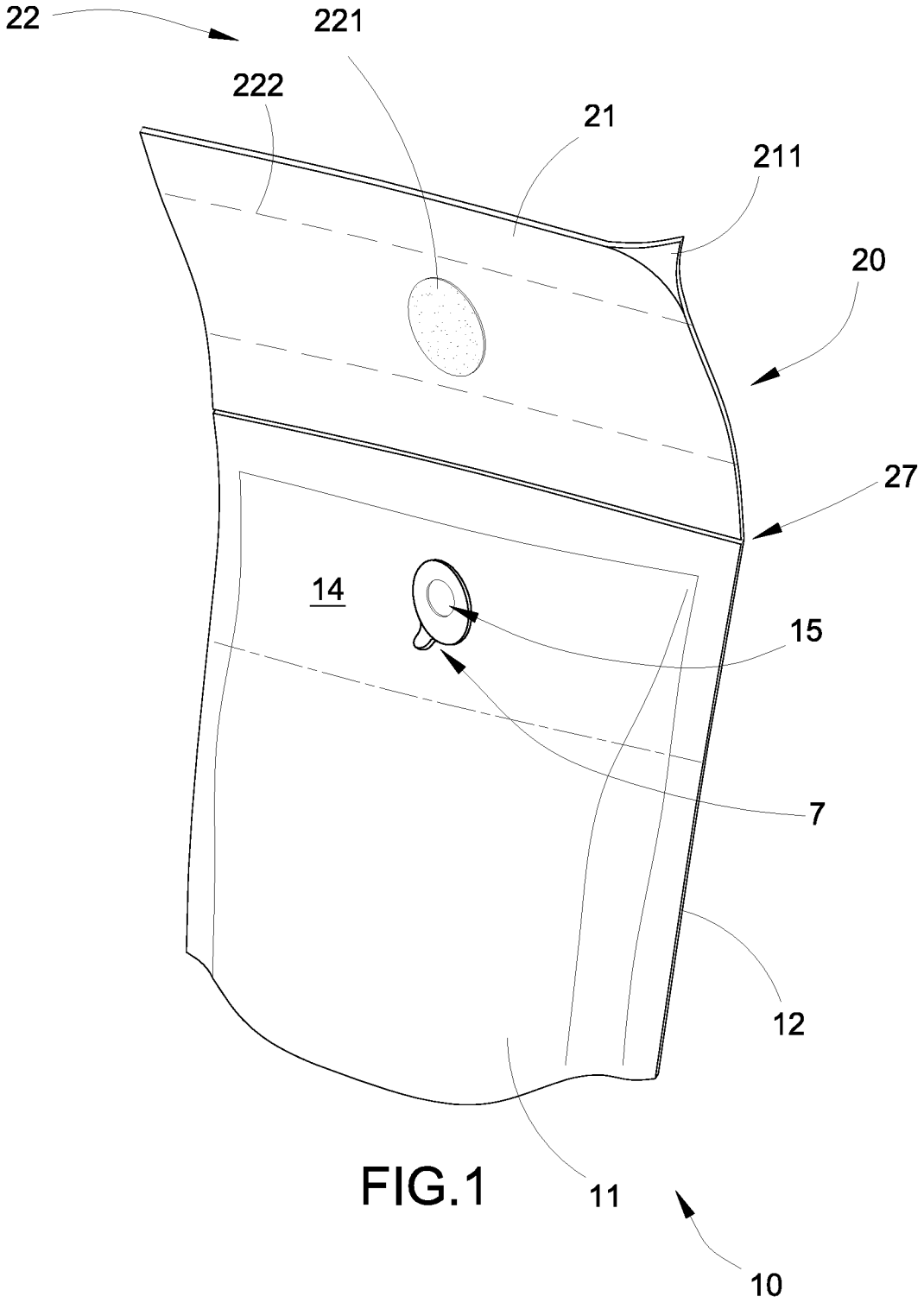
FIG. 1 is a perspective view of a beverage packet with a drinking arrangement according to a preferred embodiment of the present invention, illustrating a folded position of a sealing flap.
Figure 2:
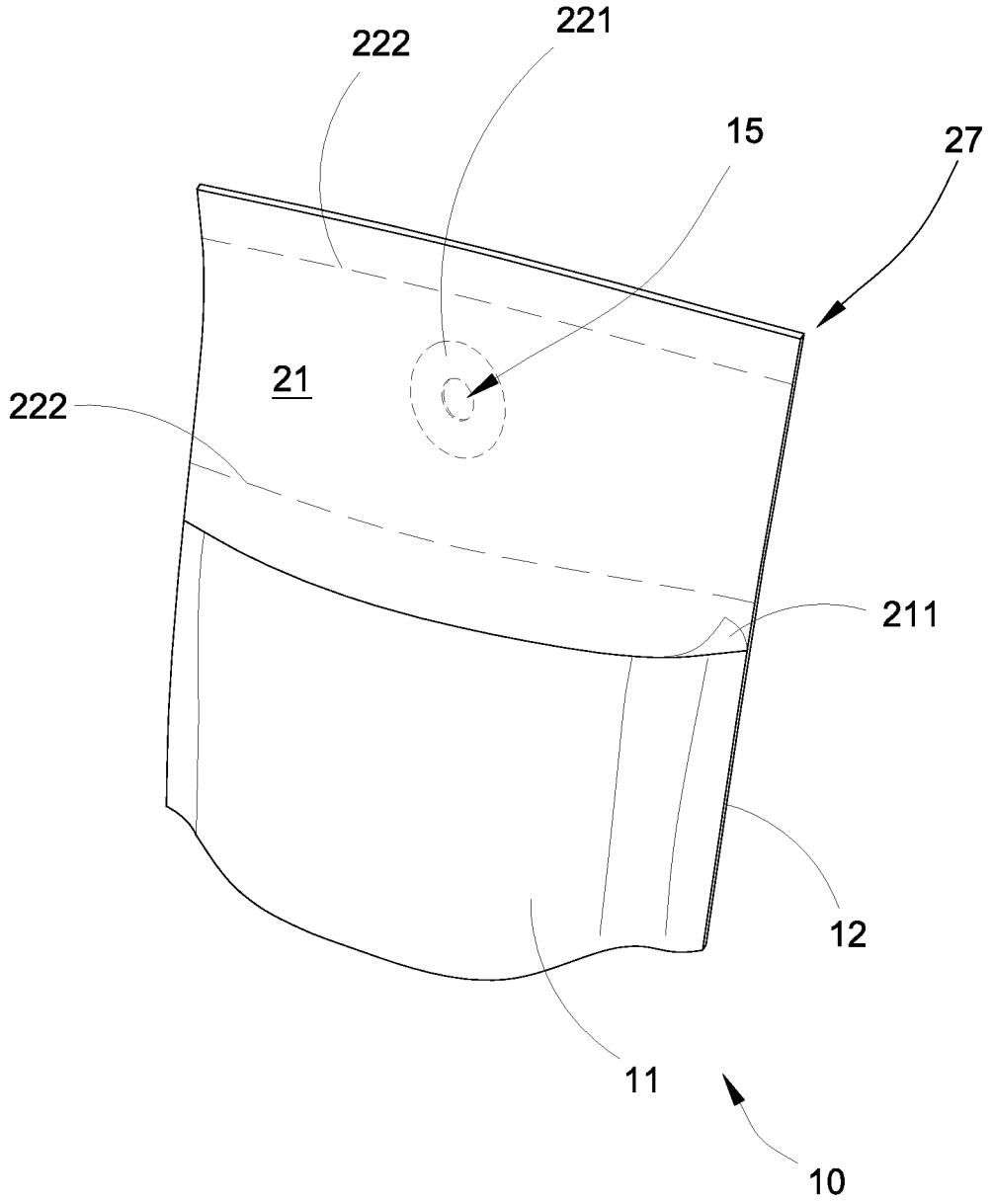
FIG. 2 is a perspective view of the beverage packet according to the above preferred embodiment of the present invention, illustrating an unfolded position of the sealing flap.
Figure 3:
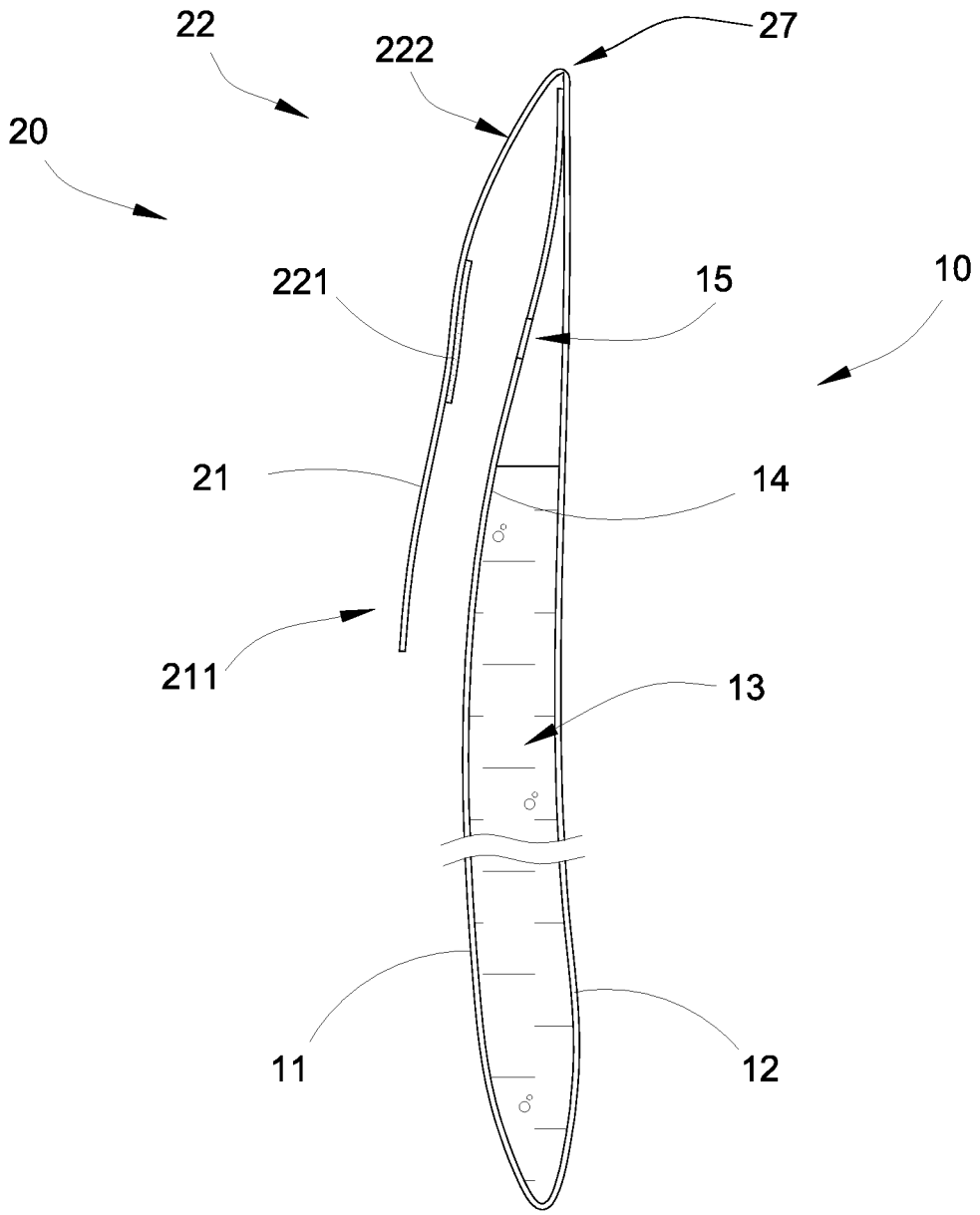
FIG. 3 is a sectional view of the beverage packet according to the above preferred embodiment of the present invention.

Referring to FIGS. 1 to 3 of the drawings, a beverage packet or a consumption packet according to a preferred embodiment of the present invention is illustrated, wherein the beverage packet comprises a beverage bag 10 for containing beverage, such as water, soft drink, juice, or alcohol, therein and a dispensing arrangement. In one example, the dispensing arrangement is a drinking arrangement 20.

The beverage bag 10 comprises a first bag wall 11 and a second bag wall 12 defining a beverage cavity 13 between the first and second bag walls 11, 12, wherein the beverage is retained in the beverage cavity 13. The beverage bag 10 further has an enclosable area 14 defined at the first bag wall 11 and a drinking opening 15 formed within the enclosable area 14. Where the drinking opening 15 can have a separated seal removal 7 before consumption and where the removal seal 7 is compressed by a pressure button 6 and it is position in place by the rim of the drinking opening 15 inserting into the circular slit on the pressure button 6.

The drinking arrangement 20 comprises a sealing flap 21 extended from the second bag wall 12 and folded on the first bag wall 11 to enclose the enclosable area 14 thereof so as to seal the drinking opening 15 by the sealing flap 21, wherein the sealing flap 21 is unfolded from the enclosable area 14 to unseal the drinking opening 15. In one example, the pressure button 6 can be a snap button formed at the sealing flap 21 while the removal seal 7 is formed at the first bag wall 11 of the beverage bag 10 at the enclosable area 14 thereof. The removal seal 7 is removed from the drinking opening 15 and the drinking opening 15 is sealed by the sealing flap 21 as shown in FIG. 2.

According to the preferred embodiment, the beverage bag 10 is made of soft to medium recyclable material, any of the 7 types of recyclable plastics, and air impermeable material, such as paper or Aluminum foil and the materials are in combination or independent. In other words, the beverage bag 10 is a squeezable bag that the user is able to squeeze the beverage bag 10. The beverage bag 10 is formed by overlapping the first and second bag walls 11, 12 with each other, wherein side edges of the first and second bag walls 11, 12 are integrally extended with each other to form the beverage cavity 13. Alternatively, two side walls are formed between the side edges of the first and second bag walls 11, 12, such that the beverage cavity 13 is formed within the first and second bag walls 11, 12, and the side walls.

As shown in FIGS. 1 to 3, the enclosable area 14 is defined at an upper portion of the first bag wall 11. Preferably, the enclosable area 14 is further defined between two side edges of the first bag wall 11. In other words, a width of the enclosable area 14 is the same as a width of the first bag wall 11. It should be appreciated that the width of the enclosable area 14 can be smaller that the width of the first bag wall 11. The enclosable area 14 cannot be larger than an area of the first wall bag 11. It is worth mentioning that the enclosable area 14 should be large enough the user's lip may only touch the enclosable area 14 but not other area of the beverage bag 10 in accordance with Food and Drug Administration (FDA).

The drinking opening 15 is formed at a center portion of the enclosable area 14. In one embodiment, the drinking opening 15 is formed along a centerline of the first wall bag 11 between the two side edges thereof and can be in various locations within set boundaries.

According to the preferred embodiment, the sealing flap 21 is arranged to move between a folded position and an unfolded position and is guided by the folding margin 27. The sealing flap 21 is sealed on the enclosable area 14 of the beverage bag 10 when the sealing flap 21 is folded and is unsealed from the enclosable area 14 of the beverage bag 10 when the sealing flap 21 is unfolded. Therefore, at the folded position, not only the enclosable area 14 but also the drinking opening 15 will be enclosed by the sealing flap 21 to keep the enclosable area 14 and the drinking opening 15 clean and untouched.

In one embodiment, the sealing flap 21 is integrally extended from the second bag wall 12 and is extended to fold on the enclosable area 14 of the first bag wall 12, as shown in FIG. 3. Accordingly, an edge of the sealing flap 21 is integrally extended from a top edge of the first bag wall 12, wherein an inner side of the sealing flap 21 is overlapped and sealed at the enclosable area 14 of the first bag wall 11. In other words, the enclosable area 14 is defined at an area covered by the sealing flap 21. The sealing flap 21 further has a pulling portion 211 unsealed with the enclosable area 14 when the sealing flap 21 is folded, wherein the pulling portion 211 is pulled to unseal the sealing flap 21 from the enclosable area 14. As shown in FIG. 1, the pulling portion 211 is formed at a corner of the sealing flap 21, such that the user is able to hold the pulling portion 211 to pull the sealing flap 21 away from the first bag wall 11, so as to unseal the sealing flap 21 from the enclosable area 14.

According to the preferred embodiment, the drinking arrangement 20 further comprises a sealing element 22 provided on the sealing flap 21 to seal the sealing flap 21 at the enclosable area 14 around the drinking opening 15. In one embodiment, the sealing element 22 comprises an adhesive sealer 221 provided on and protruded from the inner side of the sealing flap 21 to seal on the enclosable area 14, such that the adhesive sealer 221 of the sealing flap 21 is pressed to seal on the enclosable area 14 of the first bag wall 11. Particularly, the adhesive sealer 221 is pressed and sealed around the drinking opening 15. An area of the adhesive sealer 221 is larger than a diameter size of the drinking opening 15, such that the drinking opening 15 is covered by the adhesive sealer 221. Preferably, via the adhesive sealer 221 of the sealing element 22, the sealing flap 21 is re-sealable on the enclosable area 14 to enclose the drinking opening 15. The sealing element 22 further comprises one or more sealing lines 222 formed on the sealing flap 21 to seal the sealing flap 21 on the enclosable area 14. Preferably, the sealing lines 222 can be ultrasonic lines to seal the sealing flap 21 on the first bag wall 11 so as to enclose the enclosable area 14. It is worth mentioning that the sealing lines 222 can be a security tool to ensure the beverage packet never been used or opened. Once the sealing lines 222 are broken by unfolding the sealing flap 21 to expose the drinking opening 15, the sealing flap 21 cannot be re-sealed at the enclosable area 14 via the sealing lines 222. In other words, the sealing flap 21 can be re-sealed or cannot be re-sealed at the enclosable area 14 depending the type of beverage and/or the manufacturer.

Figure 4A:
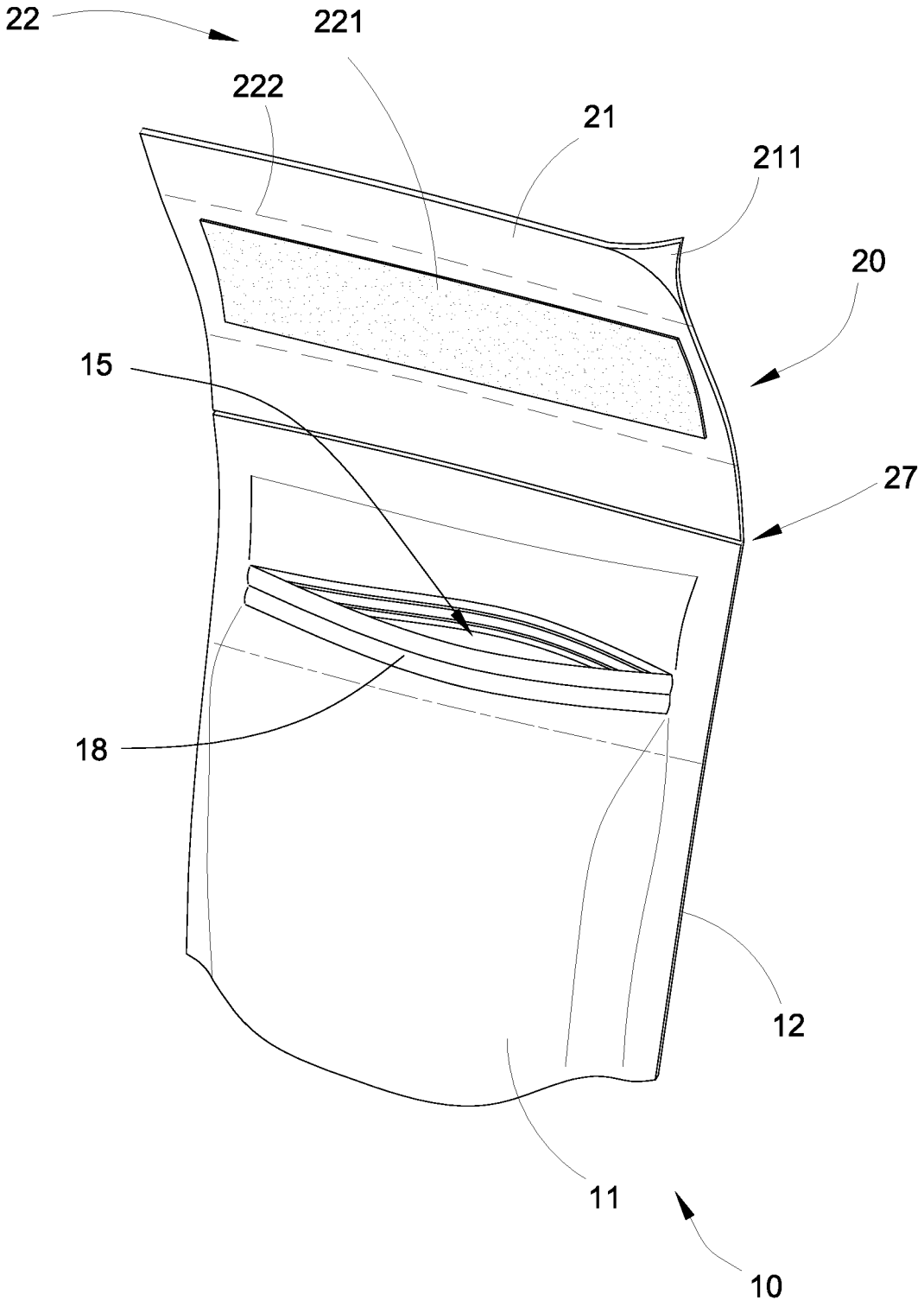
FIG. 4A illustrates a modification of the beverage packet according to the above preferred embodiment of the present invention, illustrating a zip locker at the pouch opening.
Figure 4B:
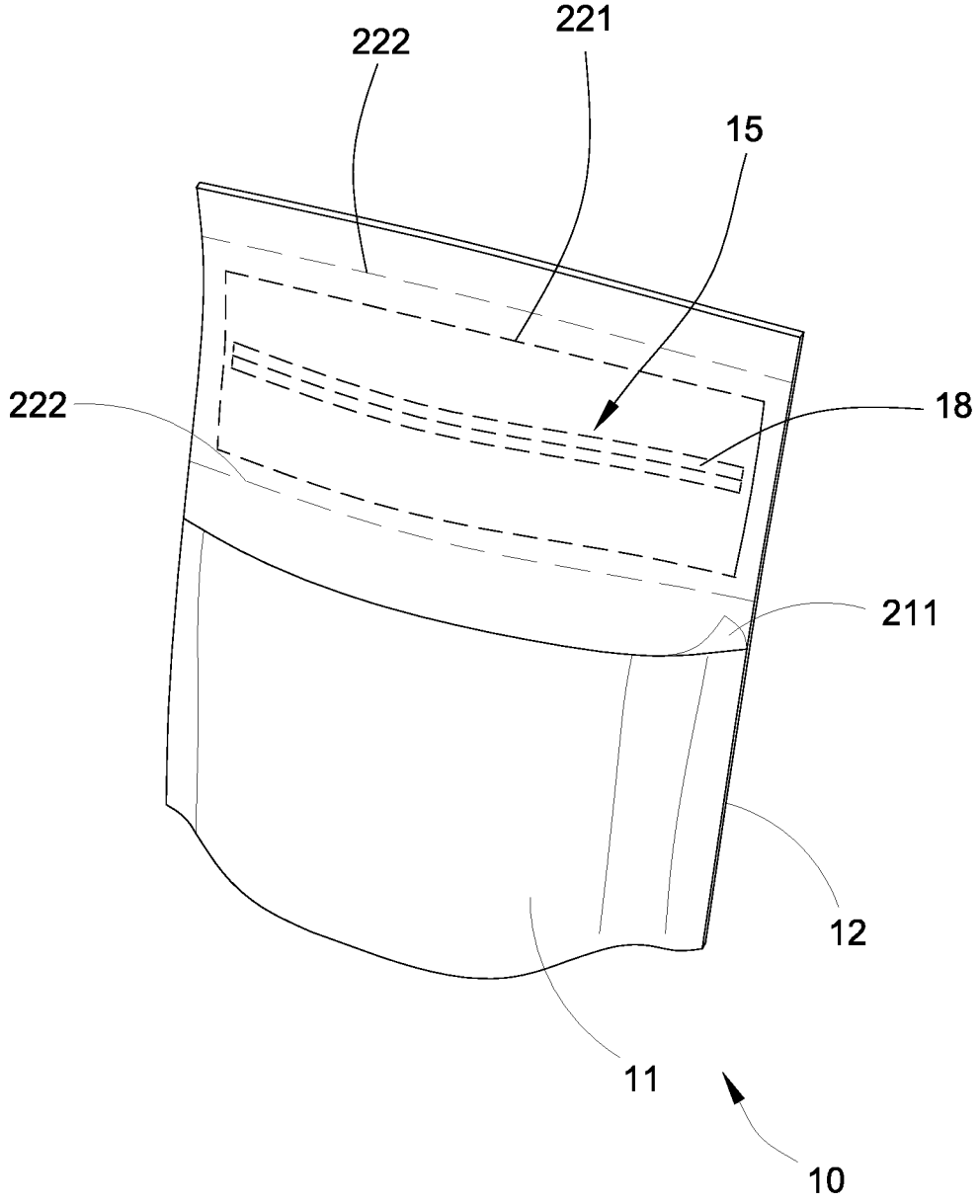
FIG. 4B illustrates the pouch opening being sealed by the zip locker and enclosed by the sealing flap according to the above preferred embodiment of the present invention.
Figure 4C:
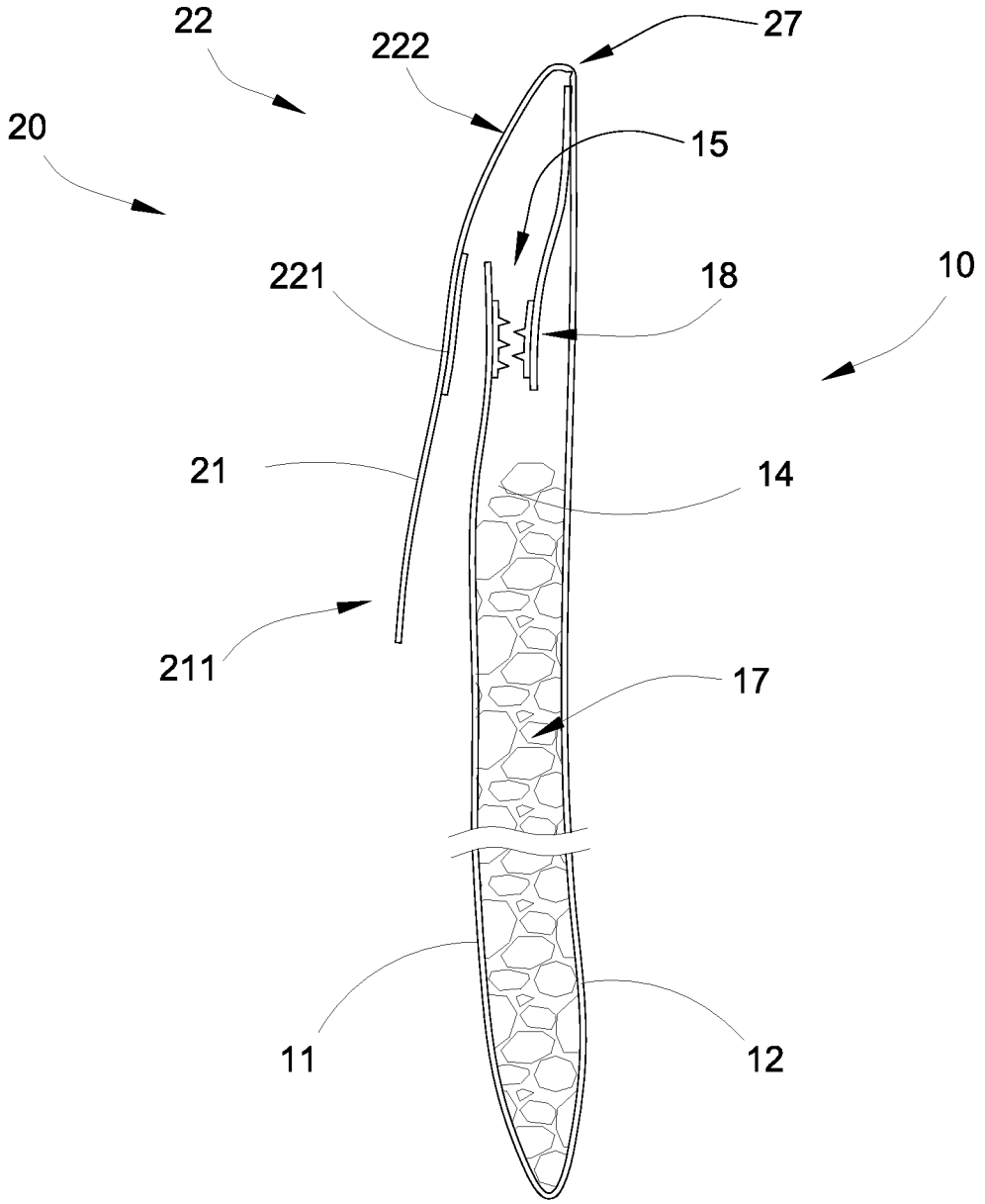
FIG. 4C is a sectional view of the beverage packet according to the above preferred embodiment of the present invention, illustrates the pouch opening being sealed by the zip locker and enclosed by the sealing flap.

Shown in FIGS. 4A-4C is a modification of the beverage embodiment FIGS. 4A-4C as it applies to non-liquids where non-beverage bag (or a product bag) 10 comprises a first bag wall 11 and a second bag wall 12 defining a non beverage cavity 17 between the first and second bag walls 11, 12, wherein the non beverage is retained in the non beverage cavity 17. The beverage bag 10 further has an enclosable area 14 defined at the first bag wall 11 and a pouch opening 15 formed within the enclosable area 14.

The non-drinking arrangement 20 comprises a sealing flap 21 extended from the second bag wall 12 and folded on the first bag wall 11 to enclose the enclosable area 14 thereof so as to seal the pouch opening 15 by the sealing flap 21, wherein the sealing flap 21 is unfolded from the enclosable area 14 to unseal the pouch opening 15. Additionally, the pouch opening 15 can have an additional sealer like a zip lock to keep the products fresh and at the same time the packet flap is another attachable/detachable sealer to keep opening area free of contaminants.

According to the preferred embodiment, the non-beverage bag 10 is made of soft to medium recyclable material, any of the 7 types of recyclable plastics, and air impermeable material, such as paper or Aluminum foil and the materials are in combination or independent. In other words, the beverage bag 10 is a squeezable bag that the user is able to squeeze the non-beverage bag 10. The non-beverage bag 10 is formed by overlapping the first and second bag walls 11, 12 with each other, wherein side edges of the first and second bag walls 11, 12 are integrally extended with each other to form the non-beverage cavity 17. Alternatively, two side walls are formed between the side edges of the first and second bag walls 11, 12, such that the non-beverage cavity 17 is formed within the first and second bag walls 11, 12, and the side walls.

As shown in FIGS. 4A to C, the enclosable area 14 is defined at an upper portion of the first bag wall 11. Preferably, the enclosable area 14 is further defined between two side edges of the first bag wall 11. In other words, a width of the enclosable area 14 is the same as a width of the first bag wall 11. It should be appreciated that the width of the enclosable area 14 can be smaller that the width of the first bag wall 11. The enclosable area 14 cannot be larger than an area of the first wall bag 11. It is worth mentioning that the enclosable area 14 should be large enough to enclose the pouch opening 15, but not other area of the beverage bag 10.

The pouch opening 15 is formed at a center portion of the enclosable area 14. In one embodiment, the pouch opening 15 is formed along a centerline of the first wall bag 11 between the two side edges thereof. Additionally the surrounding lip of the pouch opening 15 can be zip lock technology to close the pouch opening 15. For example, a zip locker 18 is provided at the pouch opening 15 having an elongated configuration, such that the pouch opening 15 can be opened and closed via the zip locker 18.

According to the embodiment, the sealing flap 21 is arranged to move between a folded position and an unfolded position. The sealing flap 21 is sealed on the enclosable area 14 of the beverage bag 10 when the sealing flap 21 is folded and is unsealed from the enclosable area 14 of the beverage bag 10 when the sealing flap 21 is unfolded. Therefore, at the folded position, not only the enclosable area 14 but also the pouch opening 15 will be enclosed by the sealing flap 21 to keep the enclosable area 14 and the pouch opening 15 clean and uncontaminated. The zip locker 18 is also covered by the sealing flap 21.

In one embodiment, the sealing flap 21 is integrally extended from the second bag wall 12 and is extended to fold on the enclosable area 14 of the first bag wall 12, as shown in FIG. 4C. Accordingly, an edge of the sealing flap 21 is integrally extended from a top edge of the first bag wall 12, wherein an inner side of the sealing flap 21 is overlapped and sealed at the enclosable area 14 of the first bag wall 11. In other words, the enclosable area 14 is defined at an area covered by the sealing flap 21. The sealing flap 21 further has a pulling portion 211 unsealed with the enclosable area 14 when the sealing flap 21 is folded, wherein the pulling portion 211 is pulled to unseal the sealing flap 21 from the enclosable area 14. As shown in FIGS. 4A to 4C, the pulling portion 211 is formed at a corner of the sealing flap 21, such that the user is able to hold the pulling portion 211 to pull the sealing flap 21 away from the first bag wall 11, so as to unseal the sealing flap 21 from the enclosable area 14.

According to FIGS. 4A to 4C, the non-drinking arrangement 20 further comprises a sealing element 22 provided on the sealing flap 21 to seal the sealing flap 21 at the enclosable area 14 around the pouch opening 15. In one embodiment, the sealing element 22 comprises an adhesive sealer 221 provided on and protruded from the inner side of the sealing flap 21 to seal on the enclosable area 14, such that the adhesive sealer 221 of the sealing flap 21 is pressed to seal on the enclosable area 14 of the first bag wall 11. Particularly, the adhesive sealer 221 is pressed and sealed around the pouch opening 15. An area of the adhesive sealer 221 is larger than a diameter size of the pouch opening 15, such that the pouch opening 15 is covered by the adhesive sealer 221. Preferably, via the adhesive sealer 221 of the sealing element 22, the sealing flap 21 is re-sealable on the enclosable area 14 to enclose the pouch opening 15. The sealing element 22 further comprises one or more sealing lines 222 formed on the sealing flap 21 to seal the sealing flap 21 on the enclosable area 14. Preferably, the sealing lines 222 can be ultrasonic lines to seal the sealing flap 21 on the first bag wall 11 so as to enclose the enclosable area 14. It is worth mentioning that the sealing lines 222 can be a security tool to ensure the beverage packet never been used or opened. Once the sealing lines 222 are broken by unfolding the sealing flap 21 to expose the pouch opening 15, the sealing flap 21 cannot be re-sealed at the enclosable area 14 via the sealing lines 222. In other words, the sealing flap 21 can be re-sealed or cannot be re-sealed at the enclosable area 14 depending the type of beverage and/or the manufacturer.

Figure 5:
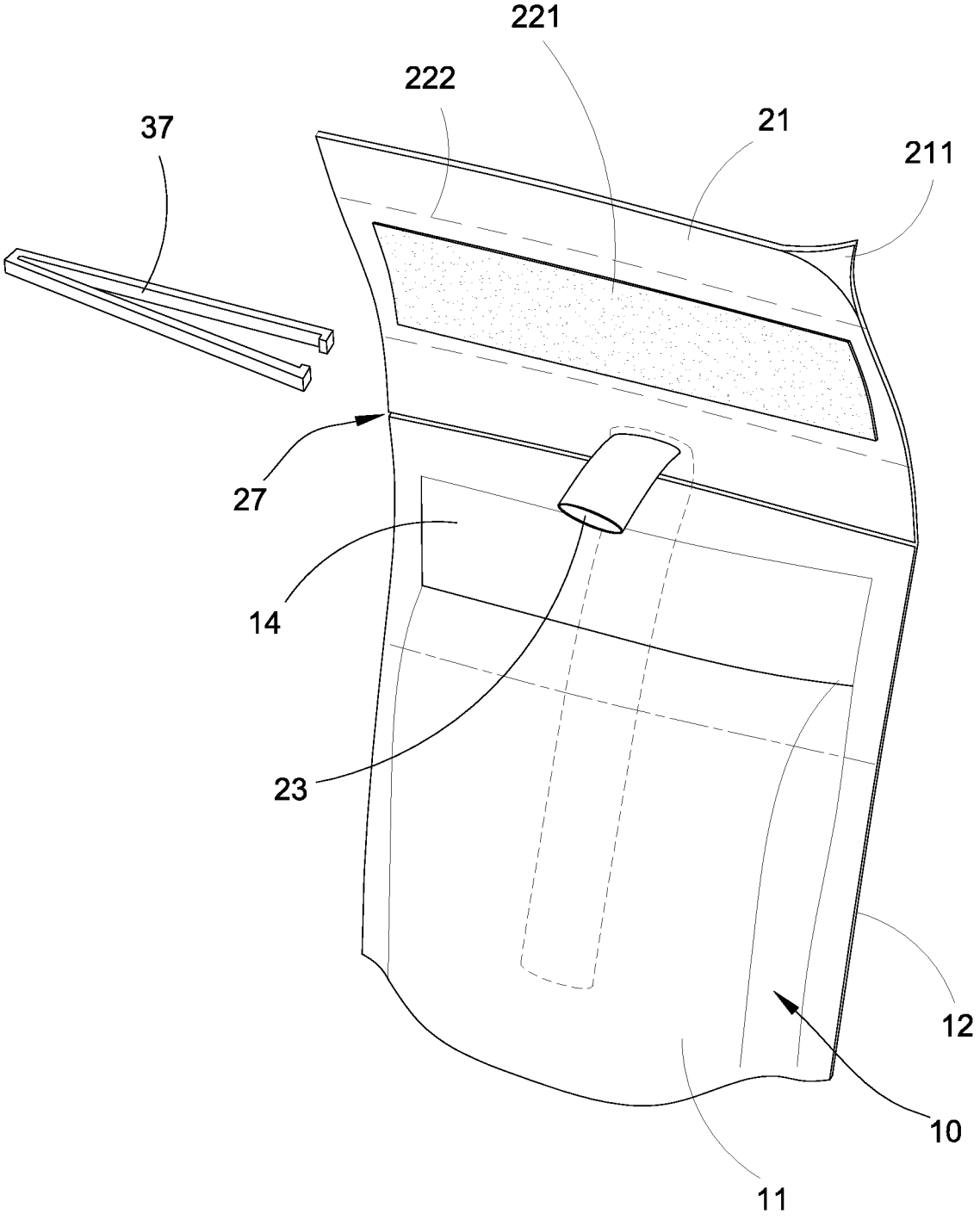
FIG. 5 illustrates a modification of the beverage packet according to the above preferred embodiment of the present invention, illustrating a straw coupled at the beverage bag.

FIG. 5 illustrate another embodiment for the drinking arrangement 20, as another example, where the sealing flap 21 and the drinking arrangement 20 work together for the purpose of preventing fluids from coming out of the beverage cavity 13 when the sealing flap 21 is close and vice versa allowing fluids to leave the beverage cavity 13 when the sealing flap 21 is open. In other words the drinking arrangement 20 can be superimposed on the beverage cavity 13 and the straw 23 or rubber plastic fluid tunnel can be in the beverage cavity 13 on one end and on the other expose end, it exists the beverage cavity 13, traversing the enclose area 14 and wrapped back around, over the folding margin 27 of the sealing flap 21, and returning back in to the inner side of the sealing flap 21. Where the expose end of the straw 23 is covered by the sealing flap 21 at the enclosed area 14 and where the folding margin 27 of the flap blocks the flow of fluids in the straw 23 or in the fluid tunnel by simultaneously folding the orifice of the straw 23 or the fluid tunnel as the sealing flap 21 is close, Vice versa the sealing flap 21 will also automatically open the orifice of the straw 23 or fluid tunnel when the sealing flap 21 is open and exposing the straw 23 and or fluid tunnel inside the enclose area 14. Additionally one can use external universal clips 37 on the outside of a close flap packer to further lock or block fluid from leaving the straw 23 or fluid tunnel structure.

Figure 6A:
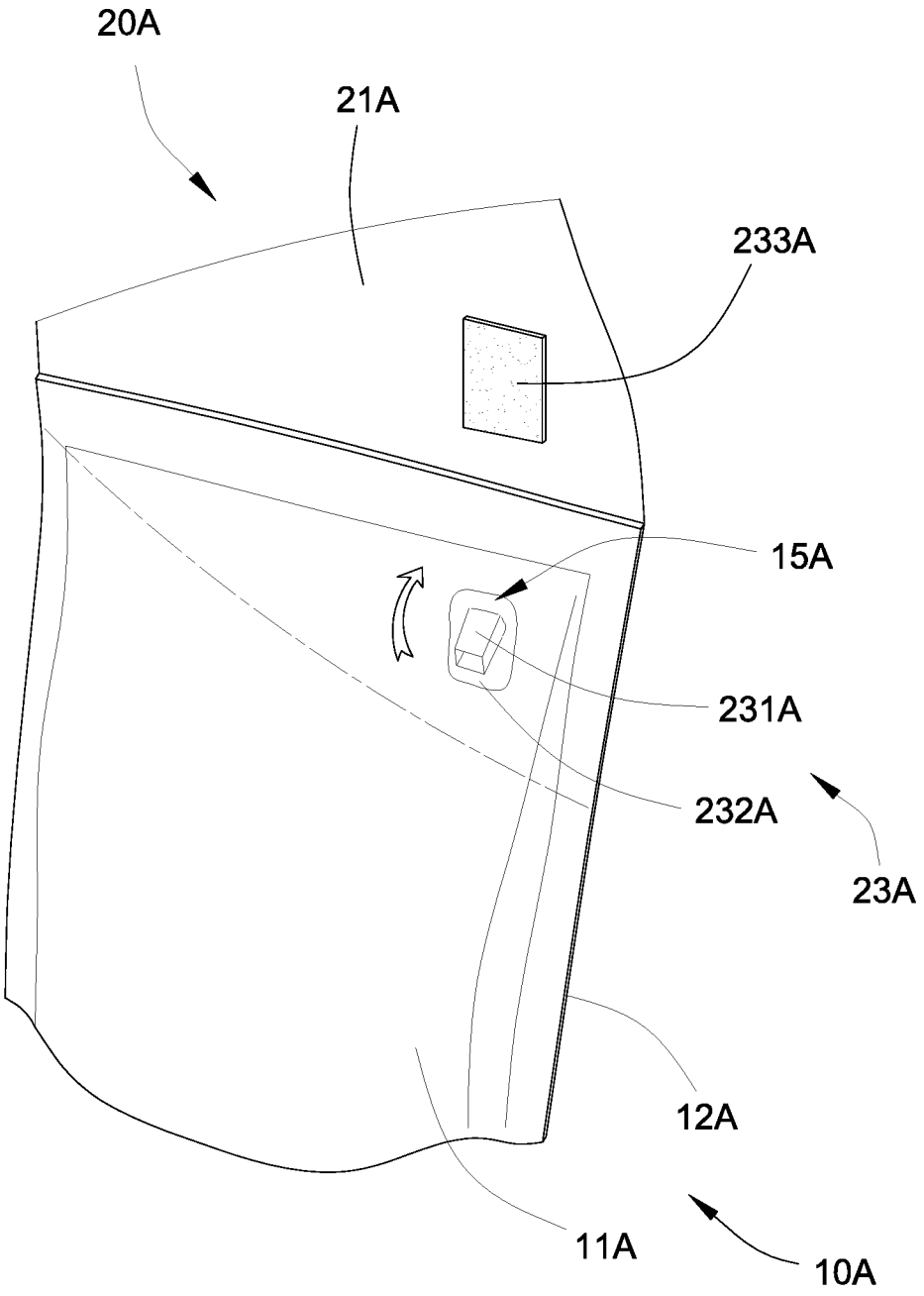
FIG. 6A illustrates a modification of the beverage packet according to the above preferred embodiment of the present invention, illustrating a foldable mouthpiece.
Figure 6B:
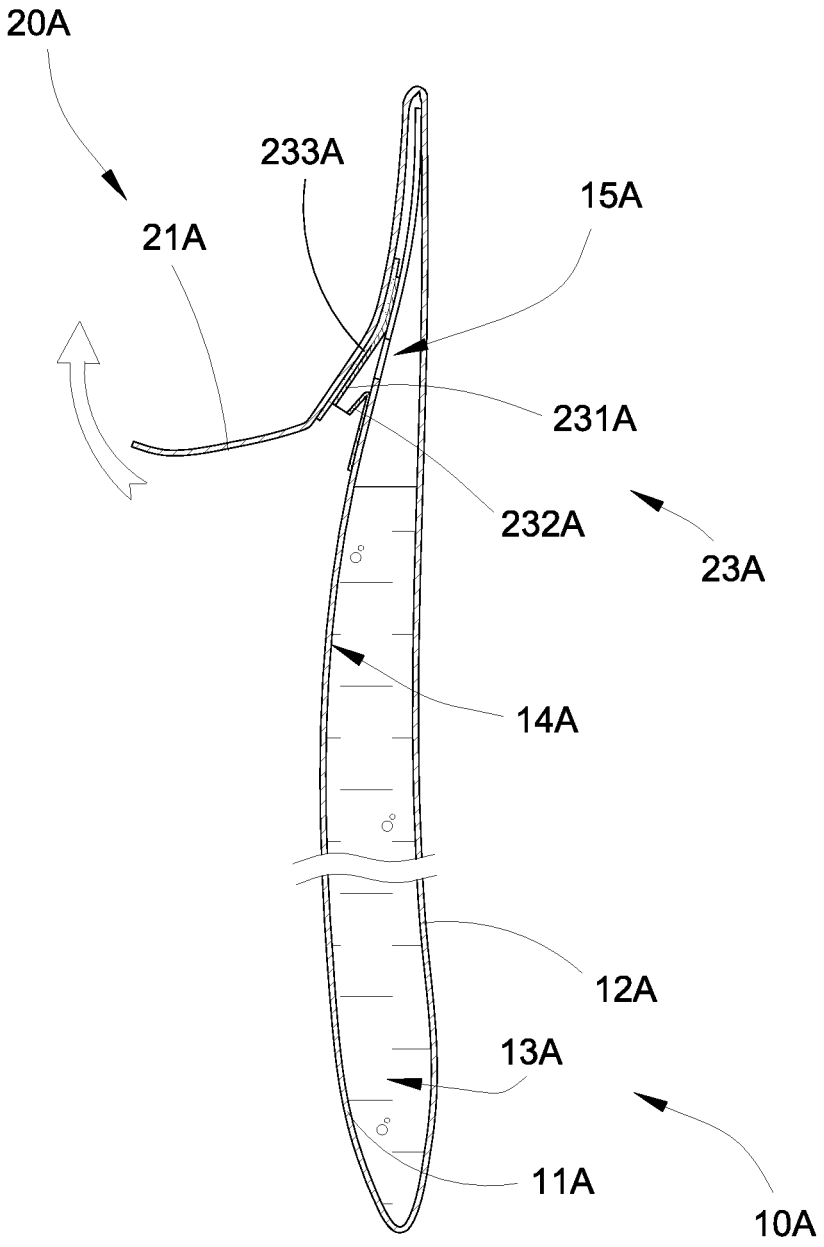
FIG. 6B illustrates the mouthpiece being folded and enclosed by the sealing flap according to the above preferred embodiment of the present invention.

FIGS. 5A and 6 illustrate a beverage packet which is an alternative mode of the preferred embodiment, wherein the beverage packet comprises a beverage bag 10A and a drinking arrangement 20A. The beverage bag 10A comprises a first bag wall 11A and a second bag wall 12A defining a beverage cavity 13A between the first and second bag walls 11A, 12A, wherein the beverage is retained in the beverage cavity 13A. The beverage bag 10A further has an enclosable area 14A defined at the first bag wall 11A and a drinking opening 15A (i.e. the pouch opening) formed within the enclosable area 14A. The drinking arrangement 20A comprises a sealing flap 21A extended from the second bag wall 12A and folded on the first bag wall 11A to enclose the enclosable area 14A thereof so as to seal the drinking opening 15A by the sealing flap 21A, wherein the sealing flap 21A is unfolded from the enclosable area 14A to unseal the drinking opening 15A.

One of the modifications is the location of the drinking opening 15A. Accordingly, the drinking opening 15A is formed at a corner portion of the enclosable area 14, i.e. one of the upper corner portions of the first bag wall 11A. In addition, the sealing flap 21A is attached to the second bag wall 12A as shown in FIG. 6. The edge of the sealing flap 21A is attached to the second bag wall 12A, wherein the sealing flap 21A is folded on the enclosable flap 14A of the first bag wall 12A.

In this modification, the drinking arrangement 20A further comprises two sealing leafs 231A, 232A extended from the enclosable area 14A around the drinking opening 15A and being overlapped with each other to seal the drinking opening 15A. Accordingly, the two sealing leafs 231A, 232A are embodied as an upper sealing leaf 231A and a lower sealing leaf 232A extended from an upper edge and a bottom edge of the drinking opening 15A, wherein the lower sealing leaf 232A is covered the upper sealing leaf 231A to seal the drinking opening 15A when the sealing flap 21A is folded. In addition, the upper and lower sealing leafs 231A, 232A are enclosed by the sealing flap 21A when the sealing flap 21A is folded. Once the sealing flap 21A is unfolded, the upper and lower sealing leafs 231A, 232A are exposed. In other words, the lower sealing leaf 232A is sandwiched between the upper sealing lead 231A and the first bag wall 11A. As shown in FIG. 5A, the upper and lower sealing leafs 231A, 232A are integrally extended with each other to form a mouth piece 23A having a tubular configuration. Therefore, once the sealing flap 21A is unfolded, the mouth piece 23A is exposed for the user to drink the beverage in the beverage bag 10A.

Additionally the drinking opening 15A can have an upper tilt comprising of the two sealing leafs 231A and 232A extended from the enclosable area 14A as demonstrated by upward tilting the mouth piece 23A and furthermore the two leafs 231A and 232A can have and independent seal over the opening 15A and not only on the sealing flap 21A.

It is important to also mention the lower sealing leaf 232A can also be completely cover and sealed by sealer 233A that is position on the sealing flap 21A and completely covering opening 15A and when the sealing flap 21A is folded away it exposes opening 15A. The drinking opening 15A can be made of soft plastic, paper or any combination and furthermore the angle of the opening can be downward as demonstrate between the upper 231A and lower sealing leaf 232A or have an upper tilt as in demonstration between the upper and lower sealing leaf's 231A and 232A. In other words, the opening 15A is collapsible.

As shown in FIG. 6, the upper sealing leaf 231A is detachably attached to the sealing flap 21A when the sealing flap 21A is folded. Preferably, the upper sealing leaf 231A is adhered to the sealing flap 21A. Therefore, when the sealing flap 21A is unfolded to expose the enclosable area 14A, the upper sealing leaf 231A is pulled upwardly by the sealing flap 21A to expose the drinking opening 15A. Via the integrated structure between the upper and lower sealing leafs 231A, 232A, the lower sealing leaf 232A is consequently pulled by the lower sealing leaf 231A to form the mouth piece 23A so as to open up the drinking opening 15A. The upper and lower sealing leafs 231A, 232A are pulled to open up the drinking opening 15A when the sealing flap 21A is unfolded. In other words, the mouth piece 23A is folded up by overlapping the upper and lower sealing leafs 231A, 232A and is concealed by the sealing flap 21A. Therefore, the drinking opening 15A is sealed by the mouth piece 23A and the sealing flap 21A. Preferably, expect the pulling portion 211A, the sealing flap 21A is entirely sealed on the enclosable area 14A of the first bag wall 11A to enclose the mouth piece 23A. And vice versa mouth piece 23A can be inverted to a upward tilt as demonstrated in FIG. 5A.

Figure 7:
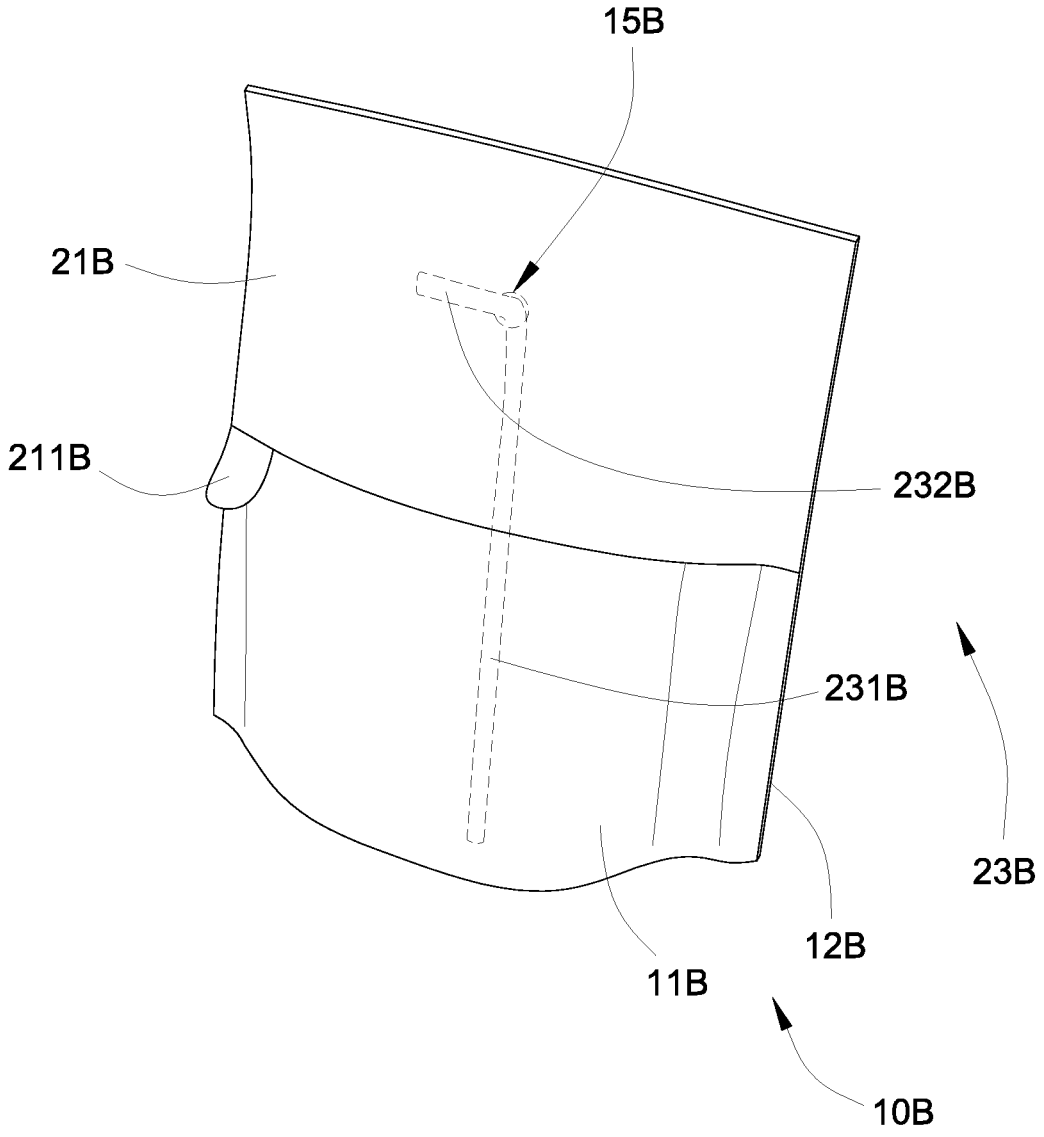
FIG. 7 illustrates another modification of the beverage packet according to the above preferred embodiment of the present invention, illustrating a stander or biodegradable drinking straw incorporated with the beverage packet or any combination.
Figure 8:
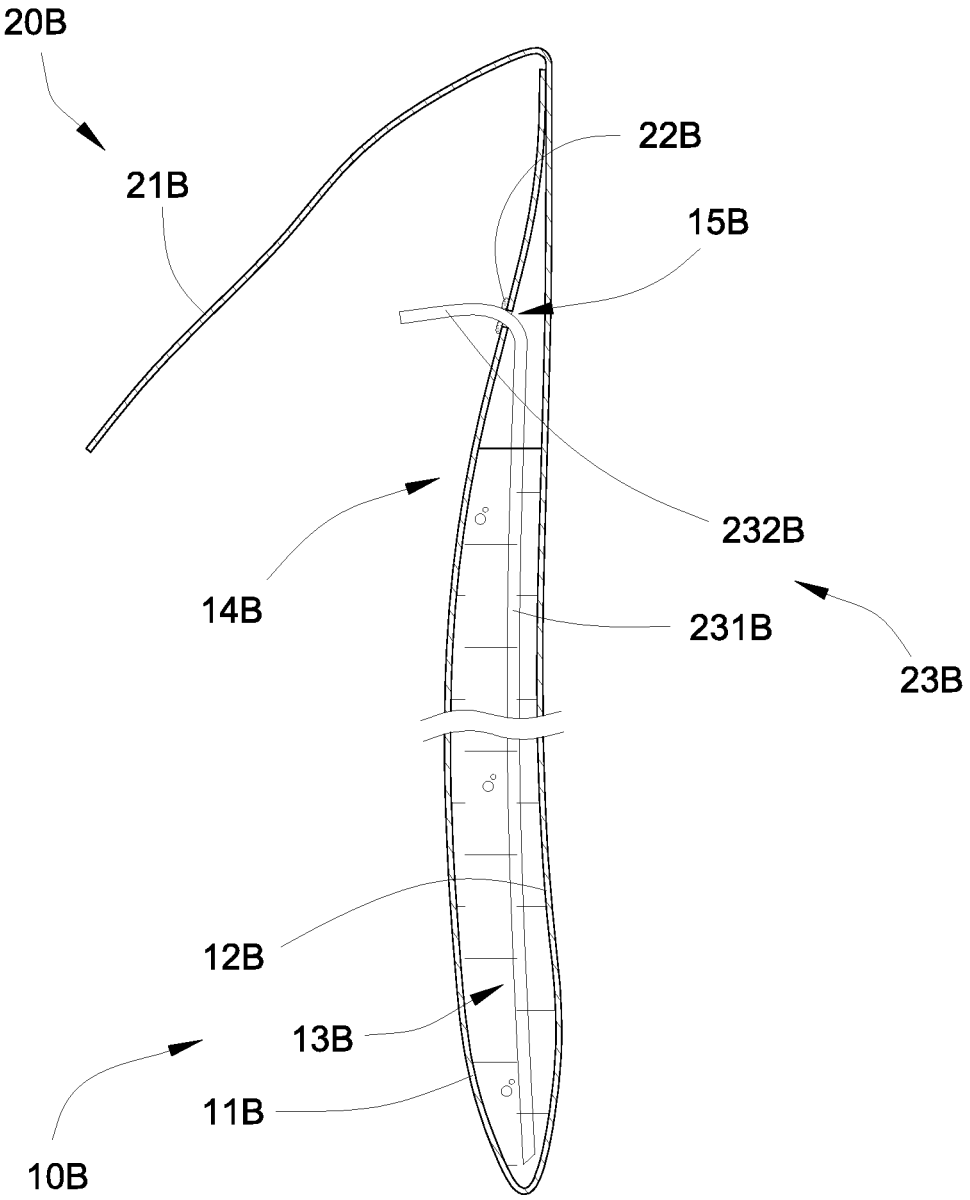
FIG. 8 is a sectional view of the beverage packet according to the above preferred embodiment of the present invention, illustrating the straw position.

FIGS. 7 and 8 illustrate a second modification of the beverage packet which is another alternative mode of the preferred embodiment, wherein the beverage packet comprises a beverage bag 10B and a drinking arrangement 20B. The beverage bag 10B comprises a first bag wall 11B and a second bag wall 12B defining a beverage cavity 13B between the first and second bag walls 11B, 12B, wherein the beverage is retained in the beverage cavity 13B. The beverage bag 10B further has an enclosable area 14B defined at the first bag wall 11B and a drinking opening 15B formed within the enclosable area 14B. The drinking arrangement 20B comprises a sealing flap 21B extended from the second bag wall 12B and folded on the first bag wall 11B to enclose the enclosable area 14B thereof so as to seal the drinking opening 15B by the sealing flap 21B, wherein the sealing flap 21B is unfolded from the enclosable area 14B to unseal the drinking opening 15B.

According to the second modification, the drinking arrangement 20B further comprises a drinking straw 23B extended through the drinking opening 15B and being sealed and covered by the sealing flap 21B when the sealing flap 21B is folded on the enclosable area 14B. Unlike the conventional beverage packet, the straw is individually packed and is externally attached to an outer side of the packet, such that the external straw may be easily lost, such as during transportation or storage. In other words, the drinking straw 23B is built-in with the beverage bag to prevent the drinking straw 23B being lost and from being separated within the beverage cavity 13.

As shown in FIGS. 7 and 8, the drinking straw 23B has a sucking portion 231B extended into the beverage cavity 13B and a mouth piece portion 232B which is extended out from the drinking opening 15B and is enclosed by the sealing flap 21B where the sealing flap 21B is folded. Accordingly, the sucking portion 231B of the drinking straw 23B is long enough to extend from the drinking opening 25B toward a bottom of the beverage cavity 13B. The mouthpiece portion 232B is extended out of the drinking opening 15B and is sealed at the enclosable area 14B between the first bag wall 11B and the sealing flap 21B. In order to retain the drinking straw 23B in position, at least a portion of the drinking straw 23B is sealed around an opening edge of the drinking opening 15B via a sealing element 22B. Preferably, expect the pulling portion 211B, the sealing flap 21B is entirely sealed on the enclosable area 14B of the first bag wall 11B to enclose the mouth piece portion 232B of the drinking straw 23B. It is worth mentioning that the pulling portion 211B is formed as a pulling tab integrally extended from an edge of the sealing flap 21B, such that when the user pulls the pulling tab to unseal the sealing flap 21B from the enclosable area 14B, the mouth piece portion 232B of the drinking straw 23B will be exposed for the user to drink the beverage in the beverage bag 10B.

It is worth mentioning that the first and second modifications are two different alternative modes of the preferred embodiment. All the features in the preferred embodiment and its alternatives are interchangeable to achieve the objective of the present invention. For example, the sealing flap 21, 21A, 21B can be either integrated with the second bag wall 12, 12A, 12B or attached to the second bag wall 12, 12A, 12B. Likewise, the pulling portion 211, 211A, 211B can be formed at a corner portion of the sealing flap 21, 21A, 21B or can be formed as a pulling tab extended from the edge of the sealing flap 21, 21A, 21B. The location of the drinking opening 15, 15A, 15B can also be altered as long as the drinking opening 15, 15A, 15B is located within the enclosable area 14, 14A, 14B of the beverage bag 10, 10A, 10B.

Figure 8A:
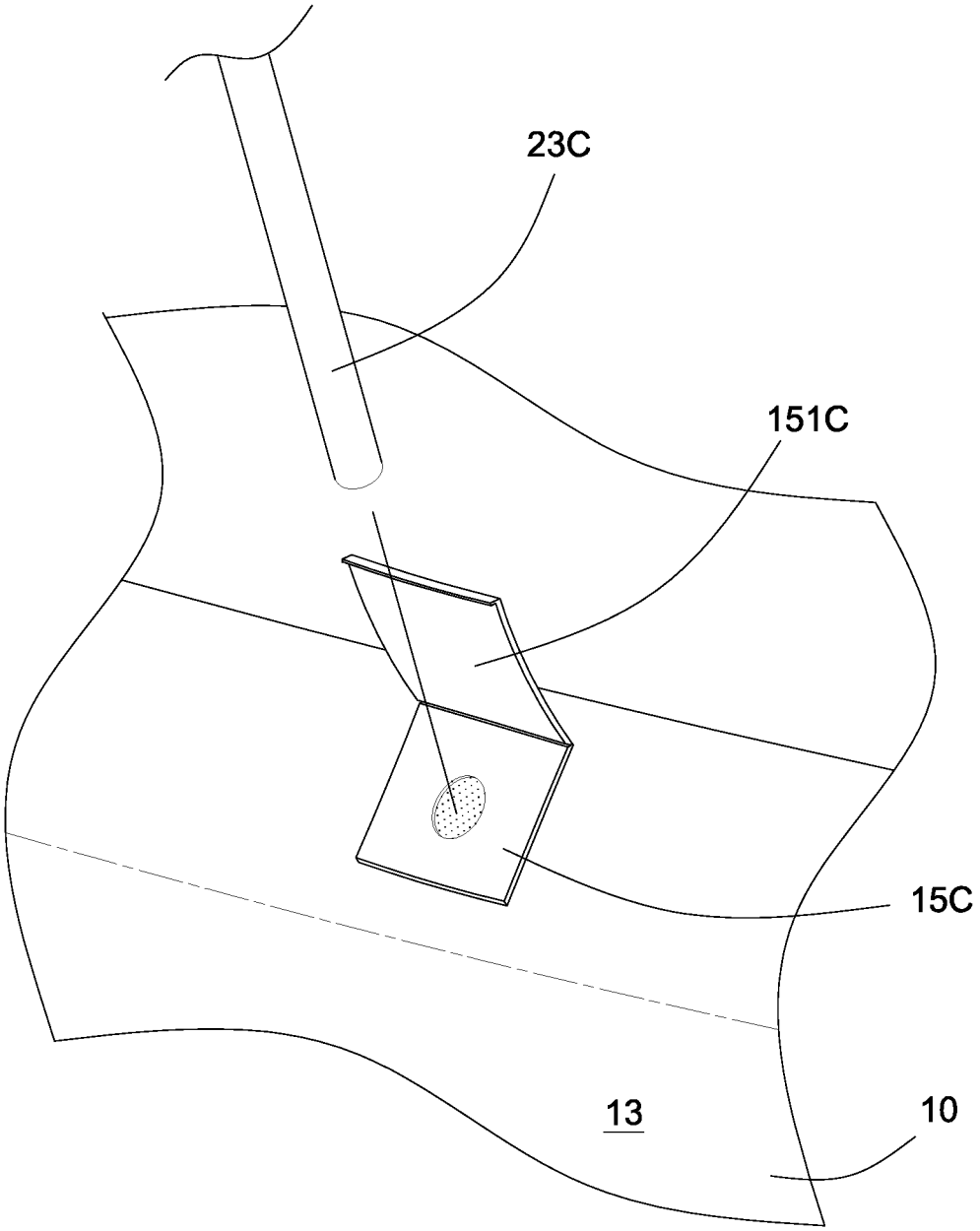
FIG. 8A illustrates the straw being folded by the sealing flap according to the above preferred embodiment of the present invention.
Figure 8B:
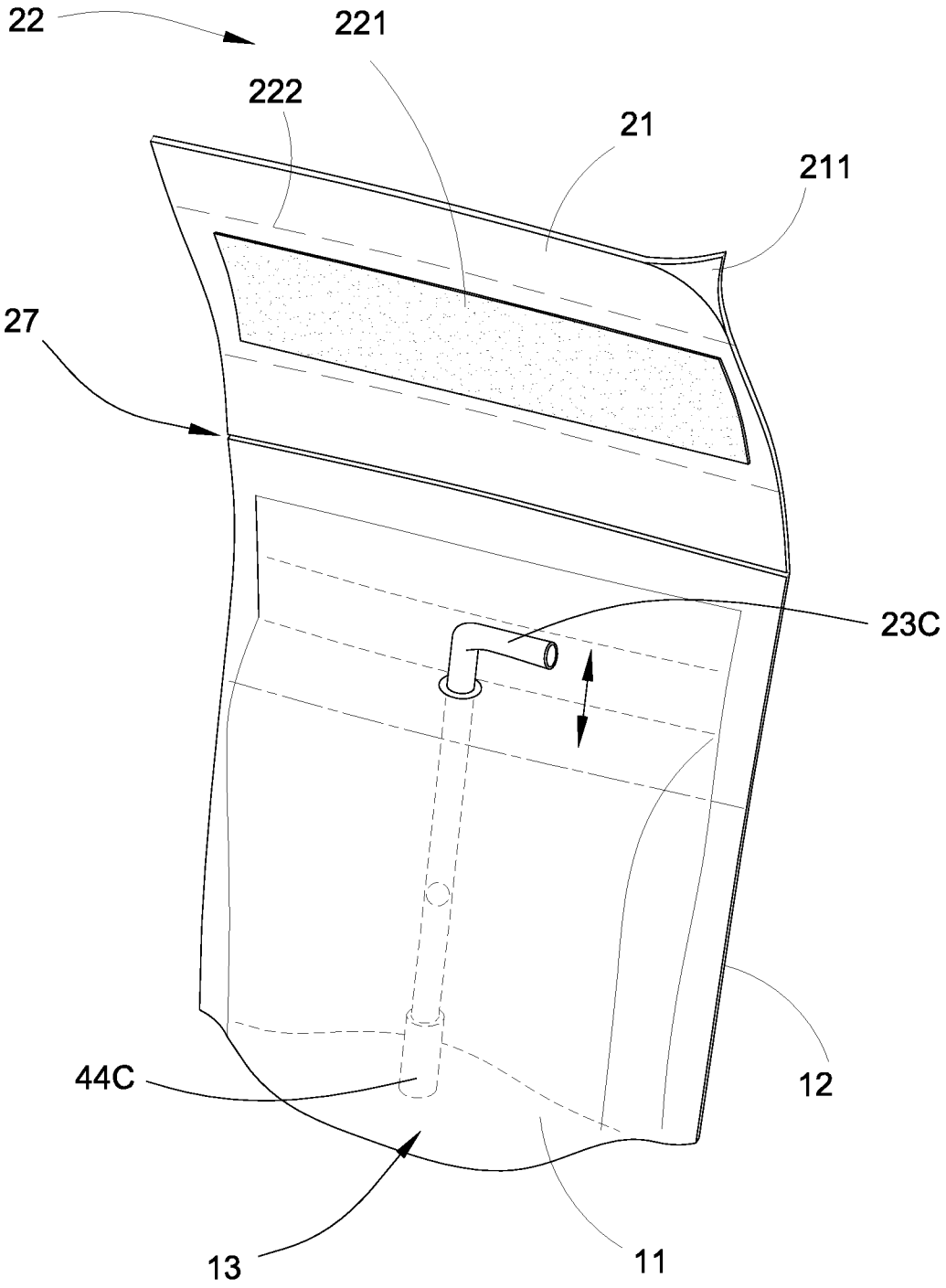
FIG. 8B illustrates the straw being bent in a L-shape and sealed by the sealing flap according to the above preferred embodiment of the present invention.
Figure 8C:
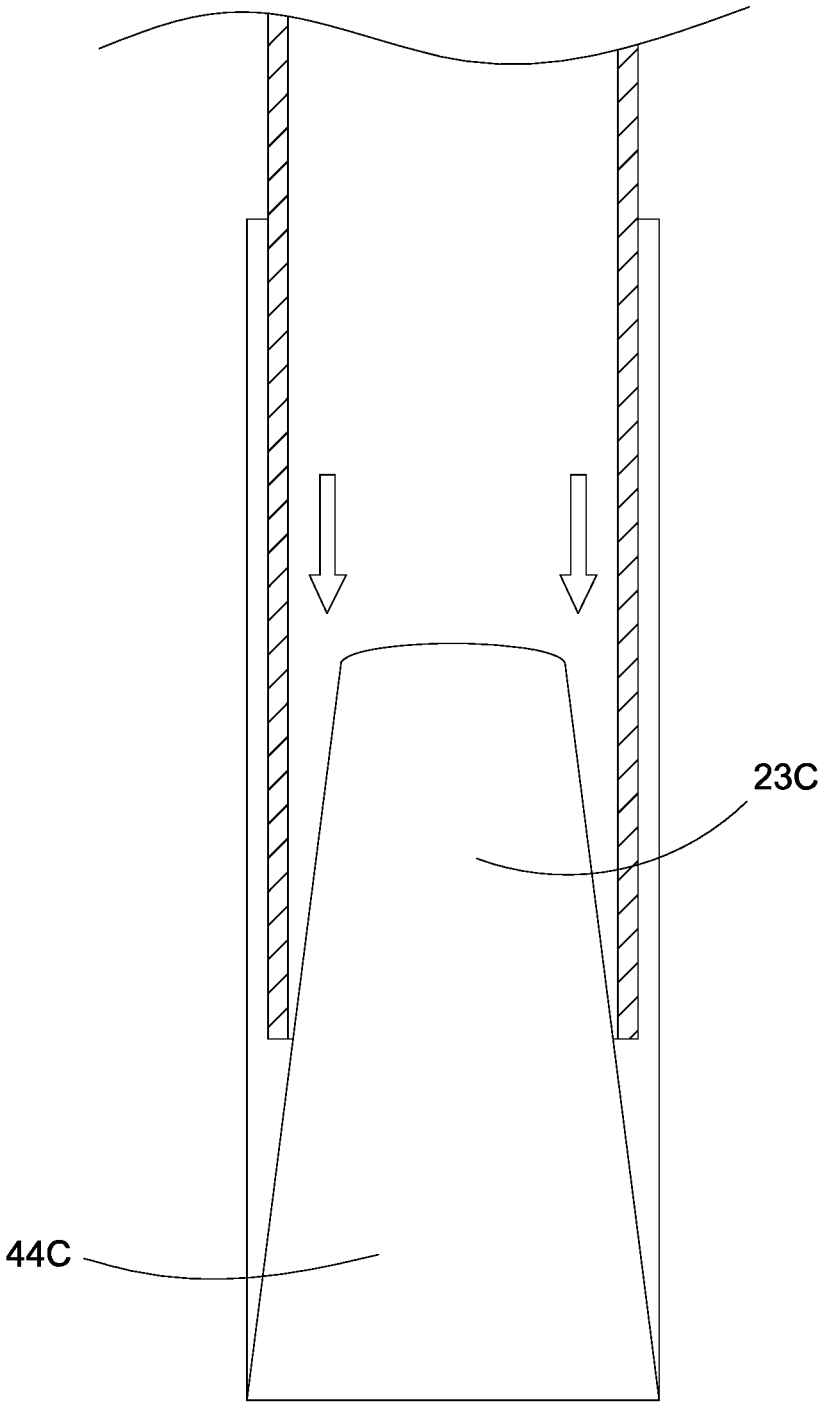
FIG. 8C illustrates a bottom end of the straw being pressed to insert into the flow valve according to the above preferred embodiment of the present invention.

FIG. 8A illustrates the opening 15C can be of a hard plastic attachment mechanical mouth piece. Where the essential mechanisms closes the orifice of the straw 23C (tube like structure) in the middle of the mouth piece and or where the orifice of the straw 23C is obstructed when close. Whether the hard plastic attachment mouth piece 151C is flick or flip upward or downward depend on the design to determine whether the orifice of the straw 23C is open or close, and vice versa. When the mouthpiece 151C is open the center orifice of the straw 23C in the hard plastic mouthpiece 151C has the orifice open to the beverage cavity 13 and thereby allowing liquid to flow out of the beverage cavity 13 on to the outside of the packet. In other words the tube, straw 23C or fluid tunnel is pinch or obstructs the flow valve 44C. FIG. 8B shows a stander plastic with a flow valve 44C where the straw 23C is obstructed by a plastic wedge nipple inside where the nipple pushes against the inner walls of the straw orifice and where the inner walls of the flow valve given a counter pressure on the outer walls of the straw thereby sealing the straw orifice rim with the flow valve 44C. FIG. 8C illustrates the operation of the flow valve 44C, wherein when a bottom end of the straw 23C is pressed to insert into the flow valve 44C, the straw 23C and the beverage cavity 13 is communicated with each other through the flow valve 44C, i.e. the flow valve 44C is opened, such that fluid in the beverage cavity 13 can be withdrawn by the straw 23C through the flow valve 44C. When the bottom end of the straw 23C is upwardly lifted from the flow valve 44C, the flow valve 44C is closed to prevent the fluid being drawn by the straw 23C.

Figure 9A:
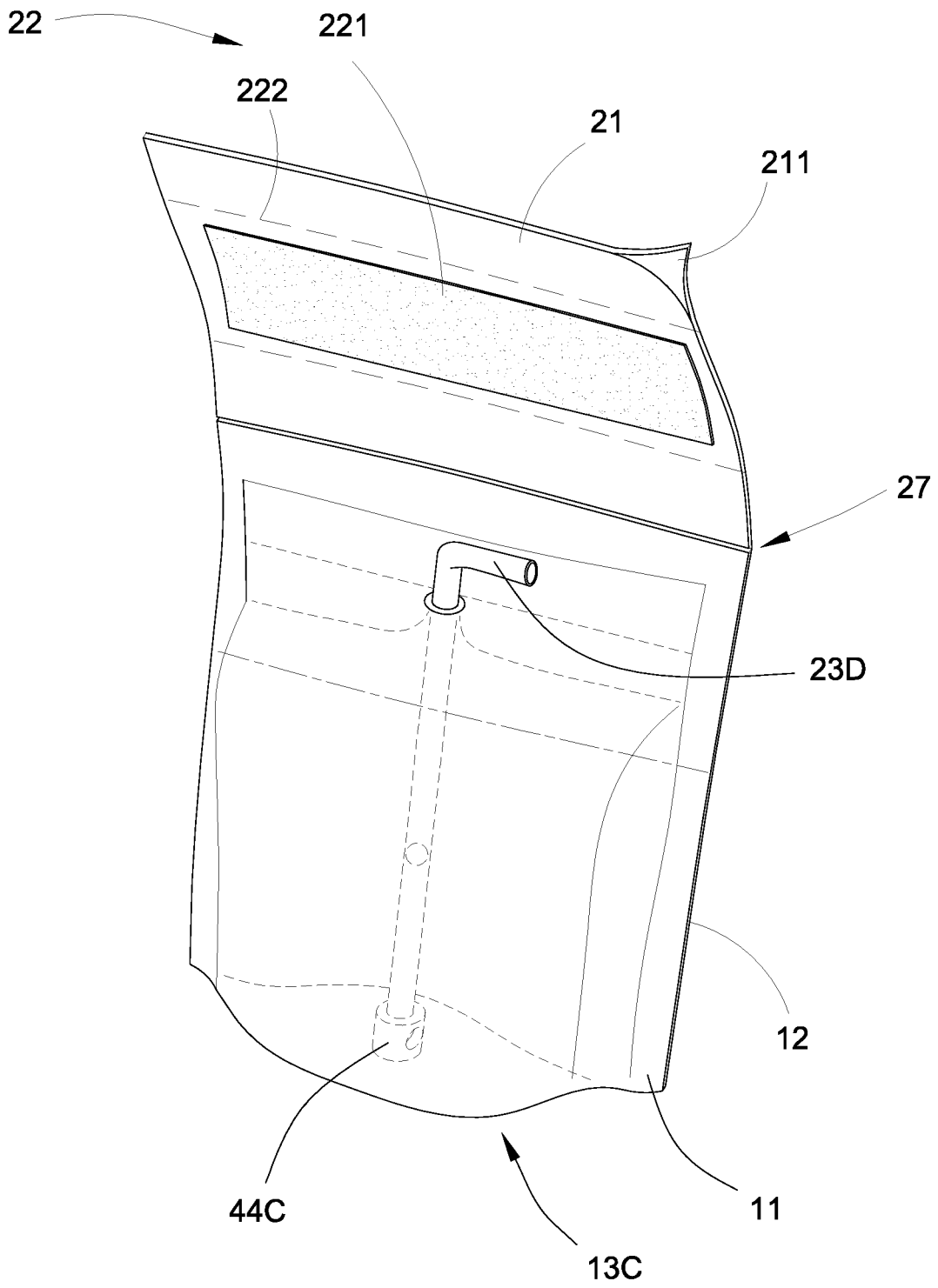
FIG. 9A illustrates an alternative mode of the flow valve of the beverage packet according to the above preferred embodiment of the present invention.

FIG. 9A illustrate the first bag wall 11 and the second bag wall 12 attach to an atypical straw made of plastic, paper, wood, or any other biodegradable composite suitable for humans to place in their mouth or intended to come in contact with oral consumption. Where the beverage cavity 13 is seal air tight with the straw 23D and where the straw 23D is allowed to have a left to right rotational motion by the internal twisting flaps 24D of the first bag wall 11 and the second bag wall 12, additionally the flap can be pre-twisted to only allowed one side rotation. The flaps will hold the straw in place because the hole on the foil paper, aluminum will not have the diameter for the straw 23D with the air tight seal to pass through wrapping this will provide stability to prevent the straw 23D from coming out the beverage cavity 13 and/or out from the flow valve 44D underneath. FIG. 9A illustrates the straw design for the flow valve 44D to work in relation with the straw 23D rotation ideally one side closes the outward flow from the inside of the straw 23D and only when the straw is turn to the center from the center of the packet will the flow valve 44D allowed liquids to flow from the beverage cavity to the outside of the packet.

Figure 9B:
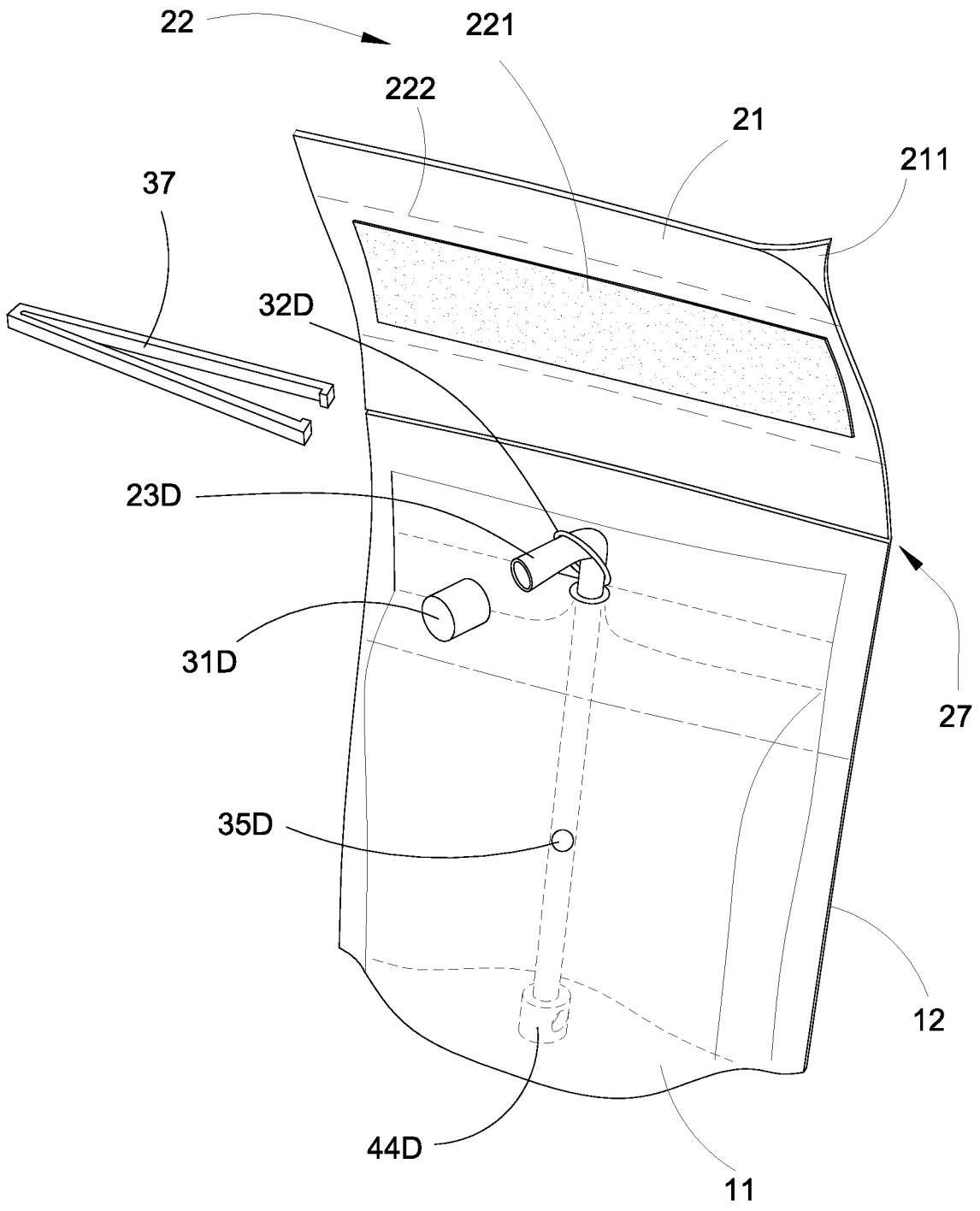
FIG. 9B illustrates the straw configuration according to the above preferred embodiment of the present invention.

FIG. 9B illustrates the straw 23D can be L shape when the straw is folded, preferably a strait straw and folded to an inverted V shape for addition pressure resistance in order to reduce leakage. In other words, the straw 23D has a main portion extended into the beverage cavity 13 and a folding portion extended from the main portion to be folded. In a typical straw the on the exposed orifice or anywhere on the straw or fluid tunnel, it can have an external removable plastic cap 31D, a sliding lock 40D, a clip 37, a pressure strip 32D, and/or a squeezable/collapsible obstruction sealer 35D. The plastic cap 31D is detachably coupled at the mouth end of the straw 23D to protect the straw 23D before it is used, wherein the user is able to use the straw 23D after the plastic cap 31D is removed.

Figure 9C:
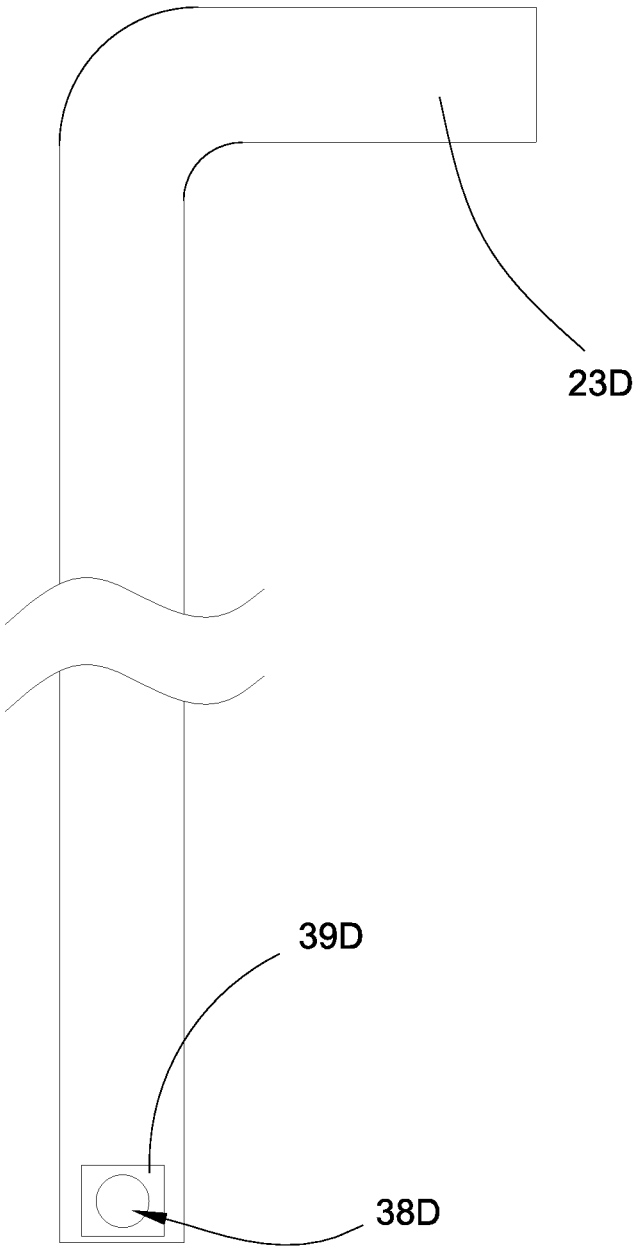
FIG. 9C illustrates the straw incorporating with the flow valve according to the above preferred embodiment of the present invention.
Figure 9D:
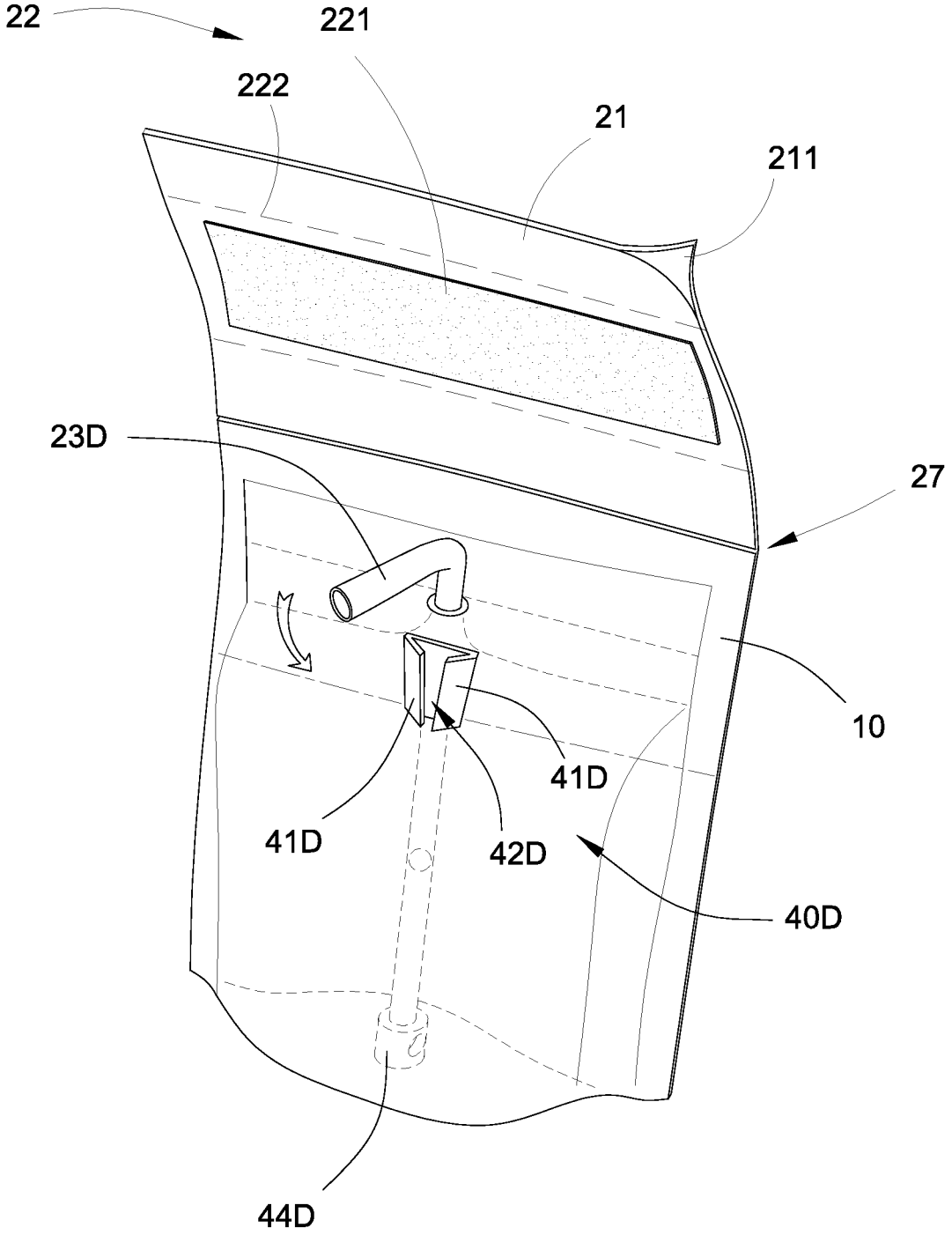
FIG. 9D illustrates the sliding lock for the straw according to the above preferred embodiment of the present invention.

As shown in FIG. 9D, the sliding lock 40D is coupled at the first bag wall 11 and is aligned with the main portion of the straw 23D, wherein the folding portion of the straw 23D is folded and locked at the sliding lock 40D. Accordingly, the sliding lock 40D, generally having a U-shaped cross section, comprises two side wedges 41D extended from a base and a locking channel 42D defined between the two side wedges 41D, wherein the folding portion of the straw 23D is folded and locked at the locking channel 42D of the sliding lock 40D. The base of the sliding lock 40D is coupled at the first bag wall 11, wherein the side wedges 41D are frontwardly protruded from the first bag wall 11 to define the locking channel 42D having a front opening. Therefore, the folding portion of the straw 23D is downwardly folded to receive at the locking channel 42D through the front opening thereof. Preferably, a width of the locking channel 42D is gradually reduced from top to bottom. The wider top opening of the locking channel 42D allows the folding portion of the straw 23D easily entering into the locking channel 42D while the narrower bottom opening of the locking channel 42D ensures the folding portion of the straw 23D being locked at the locking channel 42D. Preferably, the wider top opening of the locking channel 42D is larger than a diameter of the folding portion of the straw 23D. The narrower bottom opening of the locking channel 42D is smaller than the diameter of the folding portion of the straw 23D.

Figure 9E:
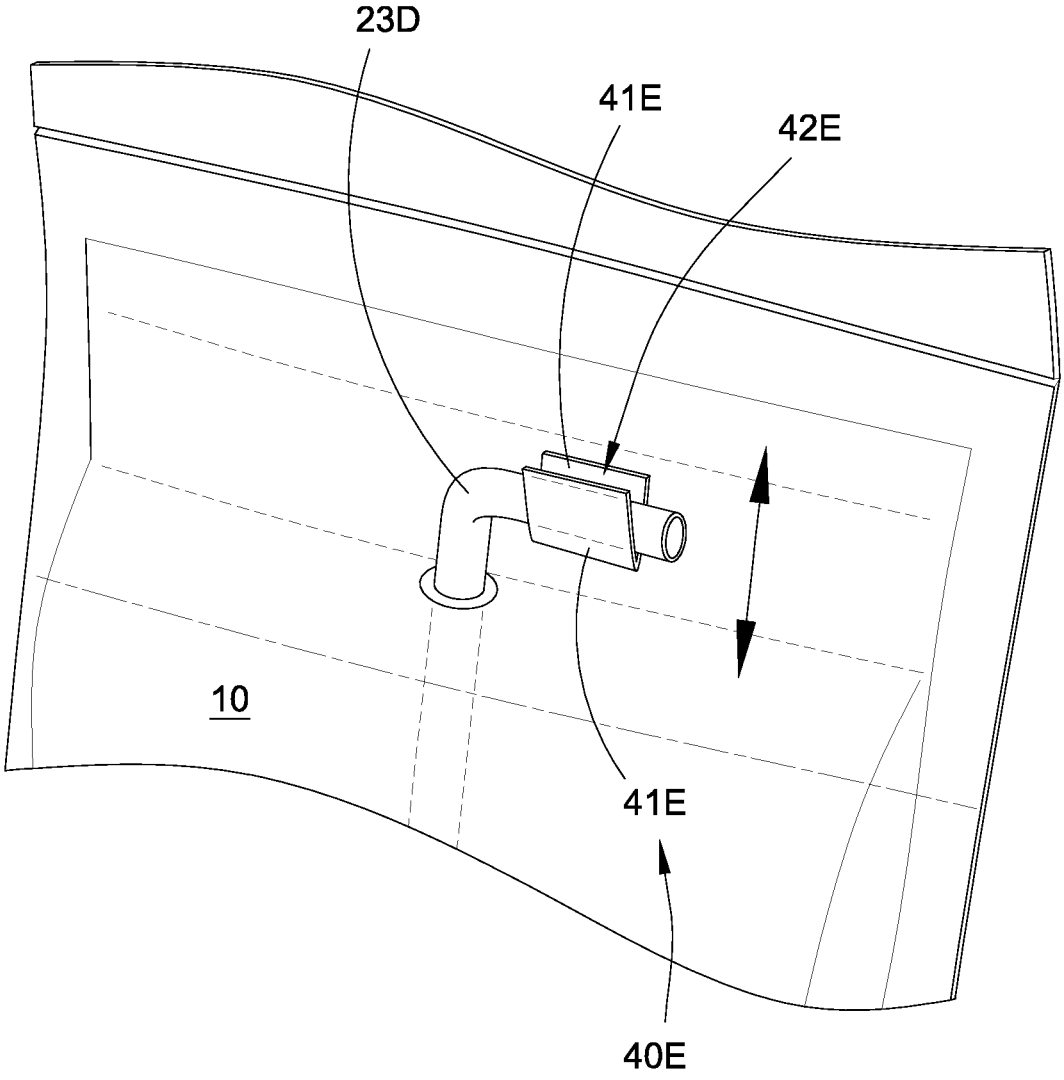
FIG. 9E illustrates an alternative mode of the sliding lock for the straw according to the above preferred embodiment of the present invention.

FIG. 9E illustrates an alternative mode of the sliding lock 40E provided at the first bag wall 11 and is aligned with the main portion of the straw 23D. Likewise, the folding portion of the straw 23D is folded and locked at the sliding lock 40E. Accordingly, the sliding lock 40E, generally having a V-shaped cross section, comprises two side wedges 41E defining a locking channel 42E therebetween, wherein the folding portion of the straw 23D is folded and locked at the locking channel 42E of the sliding lock 40E. One of the side wedges 41E is coupled at the first bag wall 11 while another side wedge 41E is frontwardly protruded from the first bag wall 11 to define the locking channel 42E having a top opening. Therefore, the folding portion of the straw 23D is downwardly folded to receive at the locking channel 42E through the top opening thereof. Due to the V-shaped configuration of the sliding lock 40E, a width of the locking channel 42E is gradually reduced from top to bottom. The wider top opening of the locking channel 42E allows the folding portion of the straw 23D easily entering into the locking channel 42E while the narrower bottom opening of the locking channel 42E ensures the folding portion of the straw 23D being locked at the locking channel 42E. Preferably, the wider top opening of the locking channel 42E is larger than a diameter of the folding portion of the straw 23D. The narrower bottom opening of the locking channel 42E is smaller than the diameter of the folding portion of the straw 23D.

As shown in FIG. 9C, additionally in the atypical straw the bottom of the straw 23D is close in relation to the beverage cavity 13 where the straw 23D will have a circular, elliptical, vertical, horizontal opening 38D on the side of the straw 23D and a thin layer of plastic cover 39D over that particular hole mention above, where the opening can be cover or uncover at one side and permanently seal by a thin layer of plastic on the right, top, and left. Where the bottom of the plastic provides an open funnel and where the plastic cover 39D and the straw 23D are not permanently sealed, in this scenario the straw 23D is atypical and it dose not have a bottom orifice, but a side orifice. That means all liquids flow upward inside the straw 23D from the circular opening 38D after passing through the bottom of the plastic cover 39D.

Figure 10:
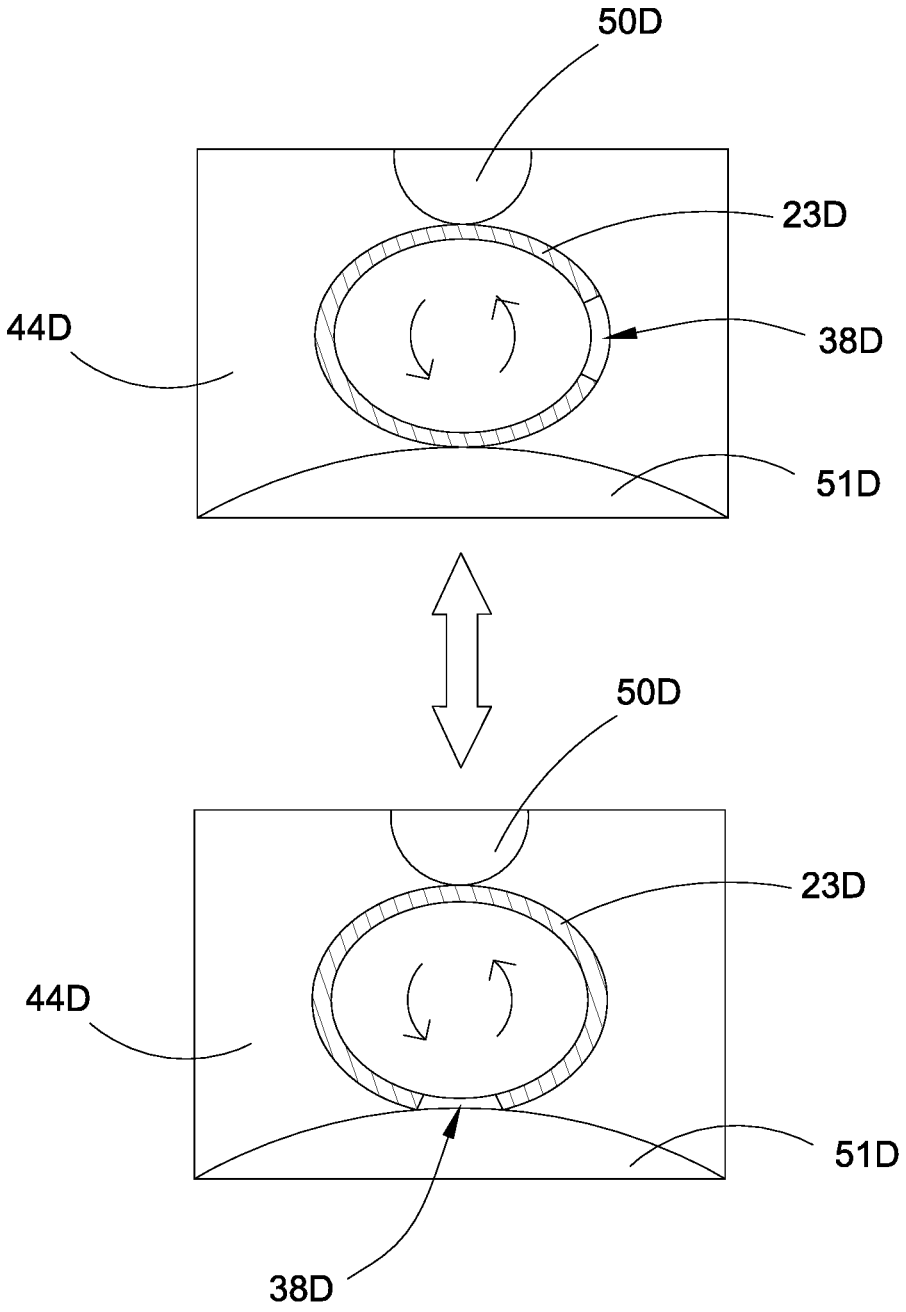
FIG. 10 illustrates the operation of the flow valve according to the above preferred embodiment of the present invention.

As shown in FIG. 10, when the an atypical straw is rotated for closure the circular hole of the straw along with the unseal bottom plastic cover are rotated to be penetrated by the plastic nipple 50D inside the square or circular flow valve 44D. The flow valve 44D has a plastic pressure level 51D directly opposite from the plastic nipple 50D this provides additional tension on the straw circular opening 38D diameter in relation to the tension between the plastic cover 39D and the rim of the circular opening when the plastic nipple 50D is penetrating the circular opening 38D diameter along with the plastic cover 39D gets seal and is locked in place by the pressure level 51D thereby preventing fluid from the beverage cavity 13 to travel into the orifice of the straw 23D. Additionally when the straw 23D is rotated to the open position the plastic nipple 50D and the plastic pressure level 51D align with each other and work together to pinch the bottom of the straw circular opening 38D creating a separation between the bottom of the plastic cover 39D and the bottom of the rim of the circular opening 38D, creating a tube like channel for the flow of liquids into the straw orifice. It is important to mention the flow valve 44D can be connected to the second bag wall 12, the first bag wall 11, on bottom in the center of both, or to the straw 23D.

Figure 11A:
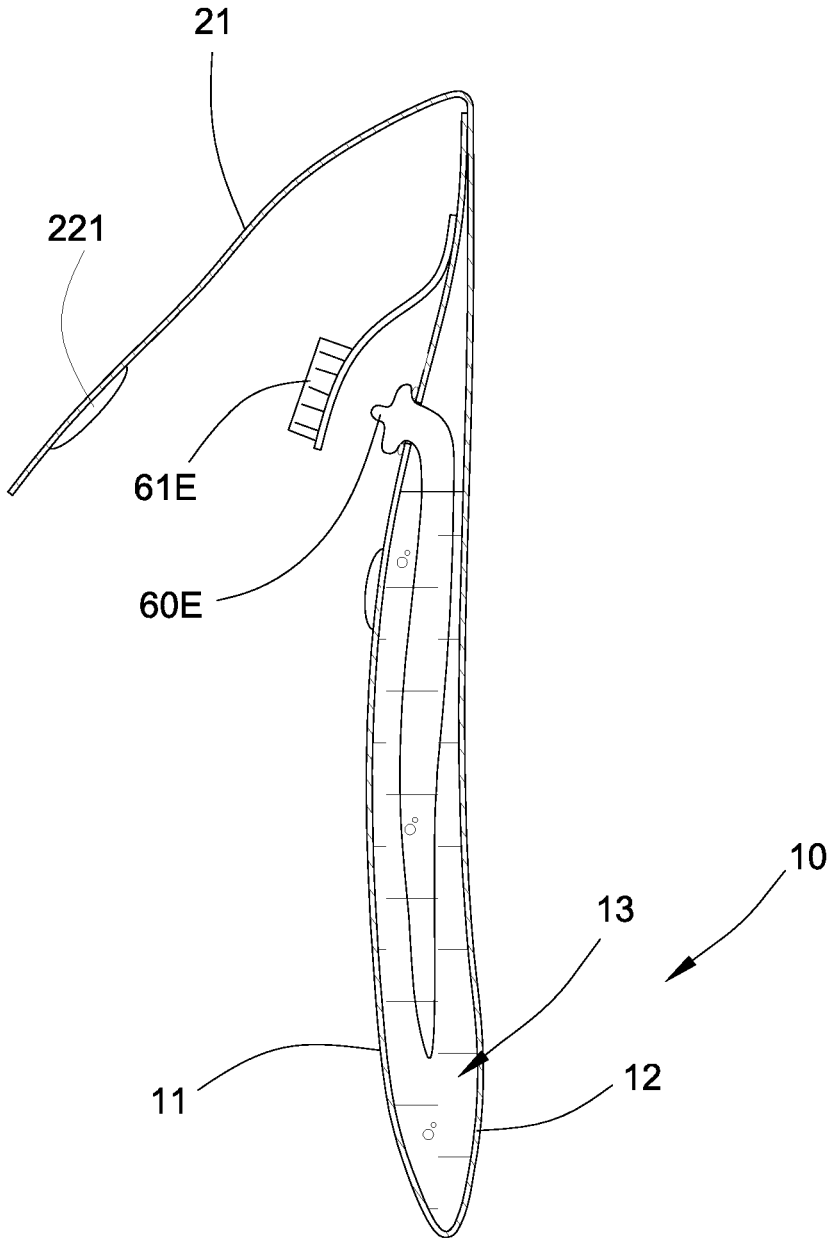
FIG. 11A illustrates the beverage packet with a dropper according to the above preferred embodiment of the present invention.
Figure 11B:
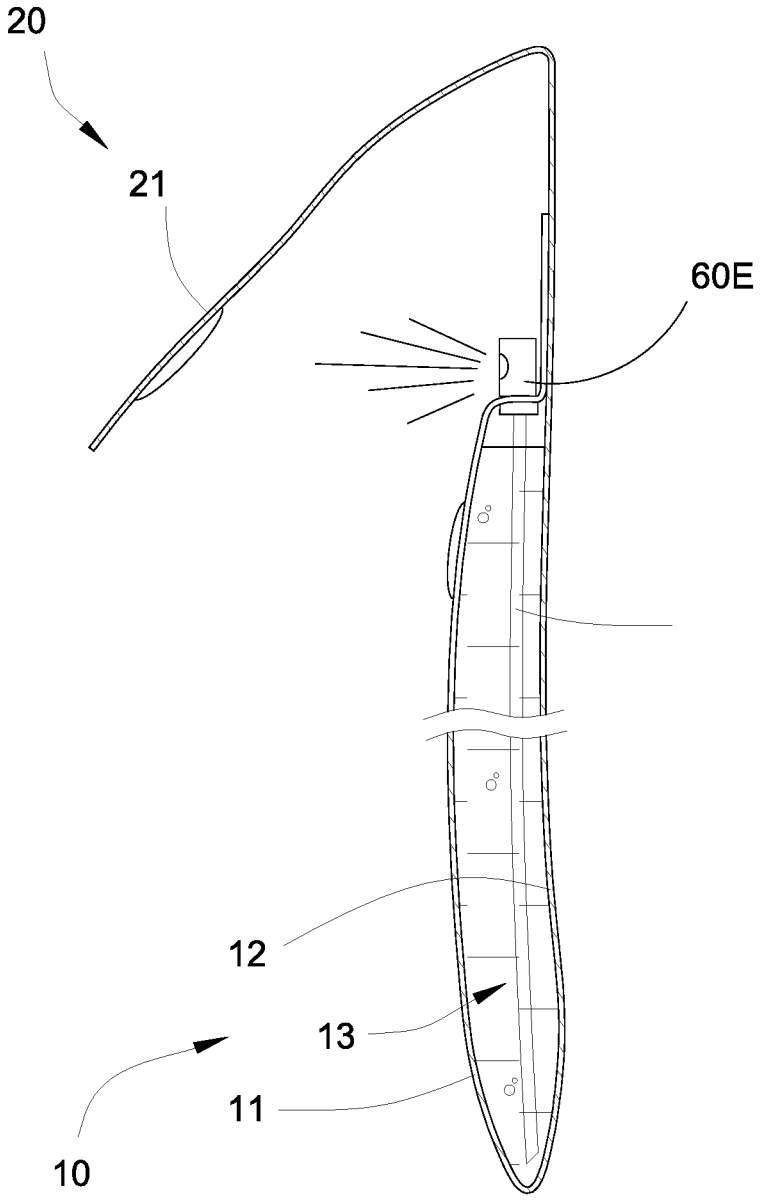
FIG. 11B illustrates the beverage packet with a sprayer according to the above preferred embodiment of the present invention.
Figure 12A:
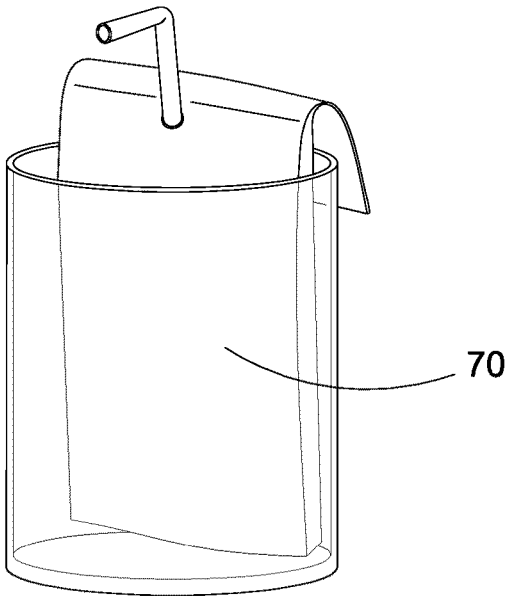
FIGS. 12A-12D illustrate a package of the beverage packet with different containers according to the above preferred embodiment of the present invention.
Figure 12B:
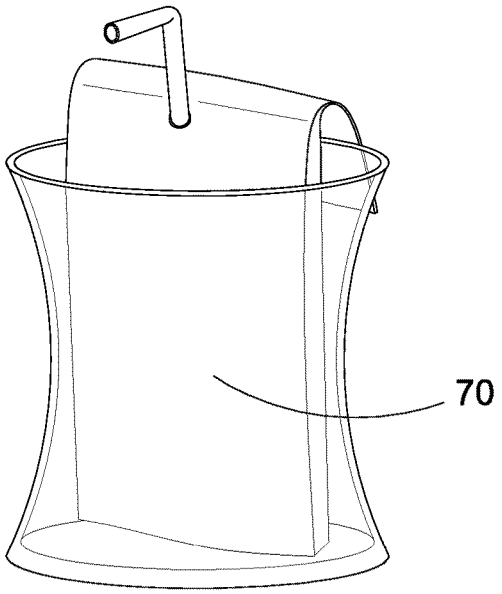
Figure 12C:
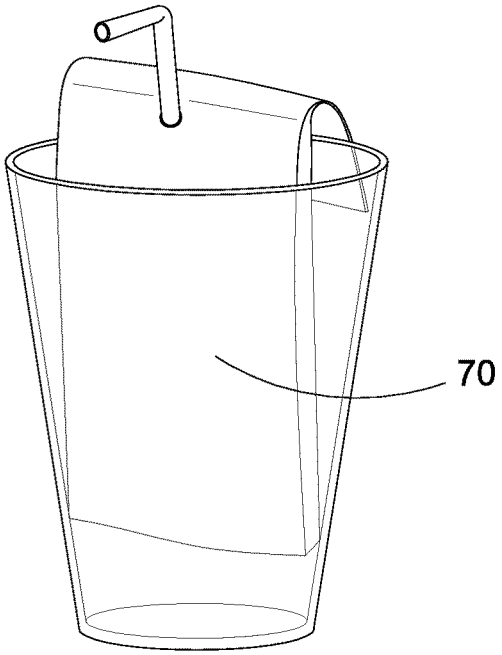
Figure 12D:
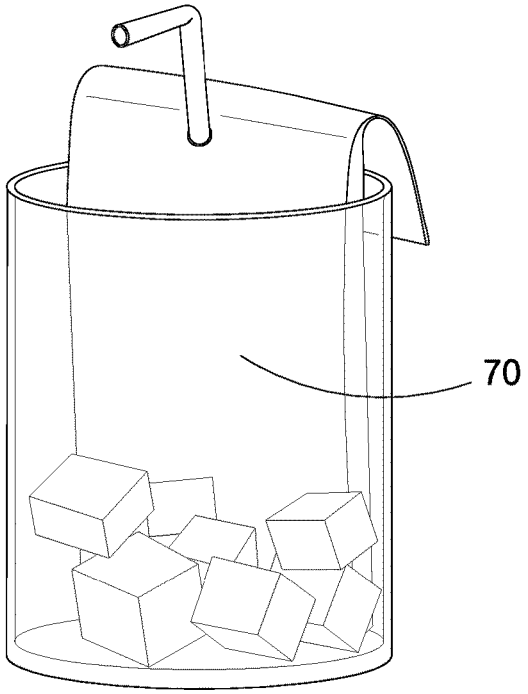

FIGS. 11A and 11B is a demonstration of the benefits of having flexible material as the container as described in the invention, where everything can be of flexible material comprising the dropper 60E and the sprayer 60E and where the flap 21 provides additional protection from dust and from contaminants for example the dropper 60E must be open to squeeze the fluid out without the flap 21 and the cap 61E is exposed to particles contaminating the open packet when the dropper 60E is open for use, as shown in FIG. 11A. The same is true for the sprayers 60E without the flap 21, the orifice of the spray hole can be contaminants where the pressure of the sprayer 60E can force contaminants on to the user, as shown in FIG. 11B. By having a flexible packets the user can obtain the fluid inside the beverage cavity 13 easier, where the tubing inside the packet works with the flexible collapsible packets and not against the rigid container.

FIGS. 12A to 12D illustrate the additional benefits to the invention consider the amount of fresh water saved around the planet by not having to wash cups, glasses where the flexibility of the packet provides the contour of standardize glasses for the presentation and convenience to the user, the establishment and the environment. Additionally the packets can be remove and reseal to carry, or place in another cup in another location or to consume while on the move. Establishments and consumer alike will have a wider range of shape and sizes of packets folded and twisted to contort to the desire glass or plastic container 70. Companies would like the advertisement on the packet and the environment will benefit by not having to use large amounts of raw material for advertisement, it is pointless, we do not need the expensive cup or glass to be a memento. All that is needed to is to change or buy the desire packet memorabilia with the desire logo and shape. The cup and glass will serve for positional holding and as a barrier for protection of direct contact with hot or cold packets.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A consumption packet, comprising:

a bag which comprises a first bag wall and a second bag wall defining a beverage cavity between said first and second bag walls, wherein said bag further has an enclosable area defined at said first bag wall and a pouch opening formed within said enclosable area and communicated with said beverage cavity; and a dispensing arrangement which comprises:

a sealing flap extended from said second bag wall and folded on said first bag wall to enclose said enclosable area thereof so as to seal said pouch opening by said sealing flap, wherein said sealing flap is unfolded from said enclosable area to unseal said pouch opening; and a dispensing tunnel element having an expose end integrally extended from said pouch opening to an inner side of said sealing flap and an extending end extending in said beverage cavity, and has an orifice communicating said beverage cavity with outside, such that when said sealing flap is folded on said first bag wall to enclose said enclosable area, said expose end is covered by said sealing flap at said enclosable area to block a flow of beverage contained in said beverage cavity, and that when said sealing flap is unfolded from said enclosable area, said expose end is exposed inside said enclosable area and the orifice of said dispensing tunnel element is opened for beverage consumption, wherein said dispensing tunnel element is a dispensing straw which further has a middle portion between said extending end and said expose end, wherein said expose end is extended out through said pouch opening and said middle portion is wrapped back around over a folding margin of said sealing flap so as to retain said expose end of said dispensing straw returning back to the inner side of said sealing flap, such that when said sealing flap is folded on said first bag wall to enclose said enclosable area, said expose end of said dispensing straw is covered by said sealing flap at said enclosable area while said folding margin blocks a flow of beverage contained in said beverage cavity in said dispensing straw, and that when said sealing flap is unfolded from said enclosable area, said expose end of said dispensing straw is exposed inside said enclosable area and the orifice of said dispensing straw is opened.

2. The consumption packet, as recited in claim 1, wherein said sealing flap is sealed on said enclosable area of said bag when said sealing flap is folded and is unsealed from said enclosable area of said bag when said sealing flap is unfolded.

3. The consumption packet, as recited in claim 1, wherein said sealing flap has a pulling portion unsealed with said enclosable area when said sealing flap is folded, such that said pulling portion is pulled to unseal said sealing flap from said enclosable area.

4. The consumption packet, as recited in claim 1, wherein at least a portion of said dispensing straw is sealed around an opening edge of said pouch opening.

5. The consumption packet, as recited in claim 4, wherein said extending end of said dispensing straw is a sucking portion extended into said beverage cavity and said expose end of said dispensing straw is a mouth piece portion which is extended out from said pouch opening and is enclosed by said sealing flap when said sealing flap is folded.

6. The consumption packet, as recited in claim 1, wherein said extending end of said dispensing straw is a sucking portion extended into said beverage cavity and said expose end of said dispensing straw is a mouth piece portion which is extended out from said pouch opening and is enclosed by said sealing flap when said sealing flap is folded.

7. The consumption packet, as recited in claim 1 wherein said dispensing arrangement further comprises a sealing element provided on said sealing flap to seal said sealing flap at said enclosable area around said pouch opening.

8. The consumption packet, as recited in claim 7, wherein said sealing element is protruded from said sealing flap to press and seal at said pouch opening when said sealing flap is folded.

9. The consumption packet, as recited in claim 7, wherein said sealing flap is re-sealable on said enclosable area via said sealing element.

* * * * *